US008978823B2

(12) United States Patent
Kreller

(10) Patent No.: US 8,978,823 B2
(45) Date of Patent: Mar. 17, 2015

(54) ARRANGEMENT OF A SCAFFOLDING COMPONENT AND OF A VERTICAL SCAFFOLDING ELEMENT

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 117 days.

(21) Appl. No.: 13/824,671

(22) PCT Filed: May 31, 2012

(86) PCT No.: PCT/DE2012/100163

§ 371 (c)(1),
(2), (4) Date: Mar. 18, 2013

(87) PCT Pub. No.: WO2012/163348

PCT Pub. Date: Dec. 6, 2012

(65) Prior Publication Data

US 2014/0030009 A1 Jan. 30, 2014

(30) Foreign Application Priority Data

Jun. 1, 2011 (DE) ..... 10 2011 050 809
Jun. 1, 2011 (DE) ..... 10 2011 050 811

(51) Int. Cl.
*E04G 7/02* (2006.01)
*E04G 7/30* (2006.01)
*E04G 7/32* (2006.01)

(52) U.S. Cl.
CPC *E04G 7/02* (2013.01); *E04G 7/307* (2013.01); *E04G 7/32* (2013.01)
USPC ..... 182/186.8; 403/49

(58) Field of Classification Search
CPC ..... E04G 7/32; E04G 7/307; E04G 7/02; F16B 7/0486
USPC ..... 403/49, 409.1; 182/186.7, 186.8; 52/638
See application file for complete search history.

(56) References Cited

U.S. PATENT DOCUMENTS 4,044,523 A 8/1977 Layher
4,530,616 A * 7/1985 Roux ..... 403/246

(Continued)

FOREIGN PATENT DOCUMENTS

AT 360 733 1/1981
CH 659 282 1/1987

(Continued)

OTHER PUBLICATIONS

International Search Report of PCT/DE2012/100164, Nov. 28, 2012.

(Continued)

*Primary Examiner* — Joshua Kennedy
(74) *Attorney, Agent, or Firm* — Collard & Roe, P.C.

(57) ABSTRACT

An arrangement includes a scaffolding component having a connection head and a vertical scaffolding element extending in the direction of a longitudinal axis with a projection fastened thereto. A wedge is plugged, in a locking position, through two wedge openings in the connection head and through an aperture in the projection. Between the upper and lower head part of the connection head a slot is open towards the front and with which the connection head is plugged onto the projection. The slot has a shoulder of the upper head part which extends downwardly from horizontal upper slot surfaces formed in an insertion region of the slot and which is arranged above the horizontal upper boundary surface of the outer projection part. The shoulder is bounded downwardly with a horizontal shoulder slot surface via which the shoulder is supported on the horizontal upper boundary surface of the projection.

13 Claims, 11 Drawing Sheets

(56) References Cited

U.S. PATENT DOCUMENTS

Figure 1:
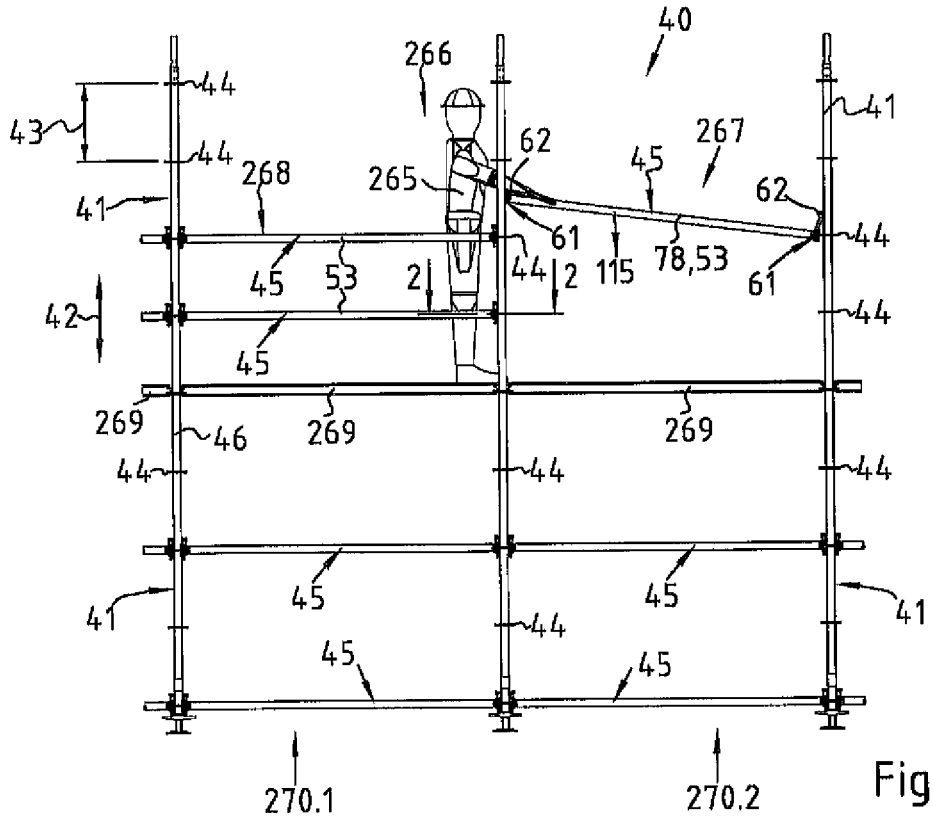

| | | | | | |
|---|---|---|---|---|---|
| 4,595,077 | A | | 6/1986 | Buttgereit | |
| 4,815,249 | A | | 3/1989 | Szucs | |
| 4,840,513 | A | | 6/1989 | Hackett | |
| 4,867,274 | A | | 9/1989 | Langer | |
| 4,958,702 | A | | 9/1990 | Langer | |
| 5,024,037 | A | * | 6/1991 | Ono | 52/646 |
| 5,127,757 | A | | 7/1992 | Langer | |
| 5,207,527 | A | | 5/1993 | Duncan et al. | |
| 5,217,314 | A | | 6/1993 | Perruelle | |
| 5,411,113 | A | * | 5/1995 | Lubinski | 182/186.7 |
| 5,868,223 | A | | 2/1999 | Lubinski | |
| 5,954,921 | A | | 9/1999 | Dahmen et al. | |
| 5,961,240 | A | * | 10/1999 | Bobrovniczky | 403/49 |
| 6,027,276 | A | | 2/2000 | Schwoerer | |
| 2006/0153631 | A1 | * | 7/2006 | Stringer | 403/49 |
| 2010/0078263 | A1 | | 4/2010 | Kreller | |
| 2012/0181111 | A1 | | 7/2012 | Brinkmann | |

FOREIGN PATENT DOCUMENTS

| | | | | | |
|---|---|---|---|---|---|
| CN | 103255910 | A | | 8/2013 | |
| DE | 1 972 690 | | | 11/1967 | |
| DE | 25 23 879 | | | 12/1975 | |
| DE | 24 49 124 | | | 4/1976 | |
| DE | 26 54 439 | | | 6/1978 | |
| DE | 35 46 045 | | | 6/1987 | |
| DE | 38 24 823 | | | 1/1990 | |
| DE | 44 30 069 | | | 2/1996 | |
| DE | 196 30 225 | | | 1/1997 | |
| DE | 195 47 382 | | | 6/1997 | |
| DE | 198 06 093 | | | 8/1999 | |
| DE | 202 00 728 | | | 4/2002 | |
| DE | 101 11 279 | | | 7/2002 | |
| DE | 101 12 370 | | | 9/2002 | |
| DE | 10225403 | A1 | * | 3/2003 | E04B 1/18 |
| DE | 202 21 675 | | | 11/2006 | |
| DE | 20 2006 015 586 | | | 2/2008 | |
| EP | 0 004 806 | | | 10/1979 | |
| EP | 0 112 831 | | | 7/1984 | |
| EP | 0 276 487 | | | 8/1988 | |
| EP | 0 351 703 | | | 1/1990 | |
| EP | 0 423 514 | | | 4/1991 | |
| EP | 0 486 381 | | | 5/1992 | |
| EP | 0 780 583 | | | 6/1997 | |
| EP | 0 936 327 | | | 8/1999 | |
| EP | 1 219 761 | | | 7/2002 | |
| EP | 1 911 907 | | | 4/2008 | |
| FR | 2 273 220 | | | 12/1975 | |
| FR | 2 520 482 | | | 7/1983 | |
| FR | 2 529 931 | | | 1/1984 | |
| FR | 2 553 456 | | | 4/1985 | |
| FR | 2752593 | A3 | * | 2/1998 | E04G 7/14 |
| FR | 2 912 476 | | | 8/2008 | |
| GB | 1 469 807 | | | 4/1977 | |
| GB | 2 061 445 | A | | 5/1981 | |
| GB | 2 165 021 | | | 4/1986 | |
| GB | 2 369 665 | | | 6/2002 | |
| JP | 50-023924 | | | 3/1975 | |
| JP | 11-022186 | A | | 1/1999 | |
| JP | 11050656 | A | * | 2/1999 | E04G 7/22 |
| JP | 11182027 | A | * | 7/1999 | E04G 7/22 |
| JP | 2004092253 | A | * | 3/2004 | E04G 7/22 |
| JP | 2013-256857 | A | | 12/2013 | |
| NO | EP 0777804 | B1 | * | 8/1995 | E04G 7/30 |
| WO | WO 83/02637 | | | 8/1983 | |
| WO | WO 94/16172 | | | 7/1994 | |
| WO | WO 97/27372 | | | 7/1997 | |
| WO | WO 02/066768 | | | 8/2002 | |
| WO | WO 2008/043339 | | | 4/2008 | |

OTHER PUBLICATIONS

International Search Report of PCT/DE2012/100163, Nov. 28, 2012.

International Search Report of PCT/DE2012/100005, May 9, 2012.

European Search Report dated Oct. 4, 2012 in European Application No. 12 17 0282 with English translation of relevant parts.

European Search Report dated Jul. 17, 2012 in European Application No. 12 16 8022 with English translation of the relevant parts.

European Search Report dated Jul. 18, 2012 in European Application No. 12 16 8019 with English translation of the relevant parts.

European Search Report dated Jul. 17, 2012 in European Application No. 12 16 8012 with English translation of the relevant parts.

European Examination Report dated Aug. 4, 2014 in European Application No. 12 170 282.3 with English translation of relevant parts.

Australian Examination Report in Australian Application No. 2012265292, dated Oct. 31, 2014.

Australian Examination Report in Australian Application No. 2012265293, dated Oct. 31, 2014.

Australian Examination Report in Australian Application No. 2012239235, dated Nov. 7, 2014.

* cited by examiner

ARRANGEMENT OF A SCAFFOLDING COMPONENT AND OF A VERTICAL SCAFFOLDING ELEMENT

CROSS REFERENCE TO RELATED APPLICATIONS

This application is the National Stage of PCT/DE2012/100163 filed May 31, 2012, which claims priority under 35 U.S.C. §119 of German Application No. 10 2011 050 811.2 filed on Jun. 1, 2011 and German Application No. 10 2011 050 809.0 filed on Jun. 1, 2011, the disclosures iof which are incorporated by reference. The international application under PCT article 21(2)was not published in English.

The invention relates to an arrangement of a scaffolding component having a connection head and of a vertical scaffolding element that extends in the direction of a longitudinal axis, onto which scaffolding element a projection is fastened, which extends transversely, in other words in a transverse direction, relative to the longitudinal axis of the scaffolding element, away from the latter, in other words toward the outside, onto which projection the connection head is mounted, with the formation of a releasable connection, particularly of a connection node, whereby the projection has an upper delimitation surface and a lower delimitation surface, which extend on both sides of an imaginary horizontal center plane of the projection that runs particularly at the height of half the vertical thickness of the projection, and whereby the projection has at least one perforation for inserting a wedge through it, which perforation is disposed between an inner projection part, in the transverse direction, of the projection, and an outer projection part, in the transverse direction, of the projection, and extends vertically between the upper and the lower delimitation surface, and whereby the connection head has an upper head part having an upper wedge opening and a lower head part having a lower wedge opening, for the wedge that can be inserted through the wedge openings, and whereby the connection head has a contact part that has contact wall parts having contact support surfaces that extend vertically, preferably parallel to the vertical axis, for contact against corresponding, vertically extending outer surfaces of the vertical scaffolding element, and whereby the upper head part has an upper contact support surface of the contact support surfaces for contact against a corresponding upper outer surface of a scaffolding element part of the vertical scaffolding element that extends above the projection, and whereby the lower head part has a lower contact support surface of the contact support surfaces for contact against a corresponding lower outer surface of a scaffolding element part of the vertical scaffolding element that extends to below the projection, and whereby a slot that is open toward the front, toward the contact support surfaces, is disposed between the upper head part and the lower head part, with which slot the connection head is mounted onto the projection, and whereby the slot, in a front introduction region for the projection, is delimited, toward the top, by horizontal upper slot surfaces of the upper head part, and toward the bottom by horizontal lower slot surfaces of the lower head part, which surfaces extend parallel or essentially parallel to one another, on both sides of an imaginary horizontal center plane of the slot, and whereby the slot is delimited, in the transverse direction, toward the rear, by vertically extending slot surfaces of a slot bottom, and whereby a passage for the wedge is configured between the upper wedge opening and the lower wedge opening, which passage extends through the upper head part and through the lower head part, intersecting the slot, and approximately aligns with the perforation of the projection, and whereby the wedge is inserted through the passage and through the perforation of the projection, so that the connection head of the scaffolding component is locked into the projection, with shape fit, using the wedge that is in a locking position, whereby the wedge can be moved through the passage toward the top, to unlock the connection head from the projection, at least up to beyond the upper delimitation surface of the projection or beyond the projection, so that then, the connection head can be removed from the projection, and whereby the upper head part is supported on the upper outer surface of the scaffolding element with the upper contact support surface, and the lower head part is supported on the lower outer surface of the scaffolding element with the lower contact support surface, either already when the wedge is in the locking position or when the wedge is in the locking position and the connection head is braced against the vertical scaffolding element using the wedge, and whereby the upper head part sits on the upper delimitation surface of the projection with a support body delimited by the upper slot surface of the slot, in a support position, and whereby in the support position, the upper contact support surface extends vertically toward the top, all the way to an upper end that is disposed at a first distance from the horizontal center plane of the slot and at a first distance from the horizontal center plane of the projection, and whereby in the support position, the lower contact support surface extends vertically toward the bottom, all the way to a lower end that is disposed at a second distance from the horizontal center plane of the slot and at a second distance from the horizontal center plane of the projection, and whereby the outer projection part of the projection has a vertical wedge support surface for the wedge, which surface is essentially level and preferably faces toward the inside, and delimits the perforation toward the outside, preferably in the transverse direction, and extends between the upper delimitation surface and the lower delimitation surface of the projection, parallel to or along or in the direction of a vertical axis, and whereby the upper head part has a vertical, upper wedge support surface for the wedge, on an inner side of the passage, in the transverse direction, which surface is preferably essentially level, faces toward the outside in the transverse direction, and extends parallel to the vertical axis, and whereby the lower head part has a vertical, lower wedge support surface for the wedge, on an inner side of the passage, in the transverse direction, which surface is preferably essentially level, faces toward the outside in the transverse direction, and extends parallel to the vertical axis, and whereby the wedge has a first wedge face edge that has a contact surface that is preferably essentially level, extends at a slant in the direction toward the inside and bottom, at an inclination angle relative to the vertical axis, along an inclined axis, facing toward the outside, which surface, when the wedge is in the locking position and the connection head is braced against the vertical scaffolding element using the wedge, and/or when the wedge is in the locking position, lies against the vertical wedge support surface of the outer projection part only locally, preferably in the region of an upper recess edge of the recess of the projection, particularly in dot form or line form, and whereby the wedge has a second wedge face edge that faces toward the inside in the transverse direction, which edge has a preferably essentially level vertical contact surface that extends parallel to the vertical axis, which surface corresponds to the vertical upper wedge support surface of the upper head part and to the vertical lower wedge support surface of the lower head part, in such a manner that the vertical contact surface of the wedge can be displaced, lying against not only the vertical upper wedge support surface of the connection head but also the vertical lower wedge support surface of the connection head, preferably over the full area, relative not only to the vertical upper wedge support surface but also the vertical lower wedge support surface, parallel to or along or in the direction of the vertical axis.

From DE 24 49 124 A1, EP 0 423 514 A2, EP 0 276 487 A2, DE 198 06 093, and EP 0 936 327 A1, for example, scaffolding constructions having connection nodes of a modular scaffolding are evident, onto the posts of which perforated disks are fastened, spaced apart from one another, in the axial direction, in a grid dimension, in order to be able to connect scaffolding components in the form of connection, holding and/or support elements there, for example longitudinal bars, transverse bars and/or diagonals. Such a modular scaffolding has been known for many years as the LAYHER Allround scaffolding system. The connection nodes or scaffolding nodes of this modular scaffolding are also known under the designation LAYHER Allround force-transmitting node.

In these connection nodes, a particularly stable, releasable connection between the scaffolding components having connection heads, particularly rod elements such as scaffolding tubes or scaffolding bars, and the scaffolding posts provided with the perforated disks, is achieved. For this purpose, the connection head of a scaffolding component, in each instance, is mounted onto one of the perforated disks of the scaffolding post, and locked in place there by means of a wedge and braced against the scaffolding post, in that usually, the wedge is wedged in place by means of a hammer blow from above.

In these designs, the wedge is installed in the locking position, in such a manner that it lies against corresponding, straight inner edges of the connection head with its front, straight front edge, which faces in the direction of the scaffolding post, while the wedge lies against an inside edge of a perforation of the perforated disk, which extends vertically or in a plumb line, with its rear, slanted rear edge, which faces away from the scaffolding post, in the form of dots or in a horizontal line.

An arrangement or releasable connection in the form of a similar connection node or scaffolding node has become known from WO 94/16172 A, in which a perforated disk made from aluminum is used. In this arrangement, the wedge is installed, in its locking position, in contrast to known connection nodes such as those that are evident from the documents already mentioned, DE 24 49 124 A1, EP 0 423 514 A2, EP 0 276 487 A2, DE 198 06 093, and EP 0 936 327 A1, rotated by 180 degrees about its longitudinal axis, so that the rear or outer vertical edge that faces radially away from the scaffolding post lies against the front or radially outer vertical inner wall of the recess of the perforated disk, over its full area, while the front or inner wedge face edge of the wedge, which faces the scaffolding post, lies against correspondingly inner edges of the connection head that are inclined toward the rear or radially to the outside and bottom. In this design, a tubular fastening sleeve is provided, onto which a perforated disk that extends perpendicular to the longitudinal axis of the sleeve, toward the outside, is welded, which disk engages around or encloses the sleeve in the circumference direction. The fastening sleeve that is provided with the perforated disk is mounted onto a vertical pipe with shape fit, to prevent rotation, by way of longitudinal ribs and grooves, and welded onto this tube. The connection head has upper contact support surfaces on its upper head part, for contact against the outer surface of the fastening sleeve, and lower contact support surfaces on its lower head part, for contact against the outer surface of the fastening sleeve. The height of the upper contact support surface above the horizontal center plane of the slot as well as above the perforated disk or its horizontal center plane is less than the height of the lower contact support surface below the horizontal center plane of the slot and below the perforated disk or its horizontal center plane. Furthermore, the upper contact support surface is smaller than the lower contact support surface. As a result, when the connection head is mounted onto the perforated disk and locked in place with the drive-in wedge and braced in place, different or asymmetrical force and moment transfer conditions, and, accordingly, different static characteristic values of the connection, come about under positive and negative bending stress. However, for safety reasons, the poorer characteristic values must always be used for the static design or calculation.

From DE 38 24 823 A1 or from the parallel EP 0 351 703 A2, a connection configuration for horizontal supports of scaffolding decking on scaffolding has become known, having vertical posts and horizontal perforated disks fastened onto them at a grid distance, and support bars releasably fastened onto the disks using connection heads having horizontal disk slots. In this design, the support bars that have connection heads consist in their entirety of light metal. In order to be able to make a connection head made of light metal available that absorbs the forces that occur in the connection region, under optimal conditions, and passes them on, which head has suitable configurations that also save space and material, which allow it to be welded to the light metal of the U-profile support bar, without influencing the material values, if at all possible, it is provided, among other things, to structure the disk slot, in the region of its inner bottom, with an inclined, upper inner delimitation that narrows to the dimension of the disk thickness. This delimitation is followed by a slanted surface that follows the upper introduction region toward the rear or outside and extends at a slant to the bottom and rear or outside. In this way, the result is supposed to be achieved that an increased material accumulation is created in the region of the greatest forces in the connection head, which accumulation is greater than in the case of conventional steel connection heads of this type, so that the stresses are reduced. Furthermore, in this way the result is supposed to be achieved that the perforated disk has precisely enough space, in other words only slight play remains, but nevertheless the disk slot is sufficiently high in the introduction region to be able to easily mount the connection head onto the perforated disk. Here, too, the heights of the contact support surfaces of the connection head braced in place by means of a wedge, which surfaces are configured on both sides of the slot, are of different sizes. As a result, accordingly different or asymmetrical force and moment transfer conditions under positive bending stress toward the top or negative bending stress toward the bottom can come about here, too. Aside from this, in the case of this releasable connection, the connection head, in a state in which it is locked and braced with the wedge, is supported on the top of the perforated disk with its inclined inner delimitation provided in the region of the slot bottom, by way of the slanted surface of the latter, in dot or line form, so that correspondingly undefined contact, positioning, and guidance conditions as well as disadvantageous force transfer conditions are present in this region. Furthermore, the slanted surface of the inclined upper inner delimitation of the slot also leads to the result that the connection head can easily slip off the perforated disk if the support bar provided with the connection head is bent toward the bottom relative to the post.

It is a task of the invention to make available an arrangement of the type indicated initially, which has improved static characteristic values of the connection or of the connection node, with advantageous possibilities for easy driving in of the wedge and for repeated bracing of the connection head against the projection or against the vertical scaffolding element, secure over a long time, as well as with advantageous positioning, alignment, mounting, and force transfer conditions.

This task is accomplished by means of the characteristics described herein or, in the case of an arrangement of the type indicated initially, particularly in that the slot, in the direction toward its slot bottom and/or in the region of its slot bottom and/or in a rear region of the slot, is structured with a shoulder of the upper head part that extends to below the upper slot surfaces of the slot configured in the introduction region, which shoulder is delimited, toward the bottom, by a horizontal upper shoulder slot surface of the slot, and whereby the shoulder, disposed in the support position above the horizontal upper delimitation surface of the outer projection part, particularly an edge crosspiece, of the projection is supported, with its full area, on the upper delimitation surface of the projection, with its shoulder slot surface that then extends parallel to the horizontal upper delimitation surface of the projection, in the support position and at least when the wedge is in the locking position and the connection head is braced against the vertical scaffolding element, using the wedge, or already when the wedge is in the locking position, so that the first distance of the upper end of the upper contact support surface of the upper head part from the horizontal center plane of the projection and the second distance of the lower end of the lower contact support surface of the lower head part from the horizontal center plane of the projection are equal in size.

Because of the fact that the outer projection part has a preferentially essentially level vertical wedge support surface for the wedge, which surface faces radially toward the inside, and delimits the perforation, preferably in the transverse direction, toward the outside, and extends between the upper delimitation surface and the lower delimitation surface of the projection, parallel to or along or in the direction of a vertical axis, and that the upper head part has a preferably essentially level vertical upper wedge support surface for the wedge, which surface faces toward the outside in the transverse direction and extends parallel to the vertical axis, and that the lower head part has a preferably essentially level vertical lower wedge support surface for the wedge, which surface faces toward the outside in the transverse direction and extends parallel to the vertical axis, and that the wedge has a first wedge face edge that has a preferably essentially level contact surface that extends at a slant in the direction toward the inside and bottom, at an inclination angle relative to the vertical axis, along a slanted axis, and faces toward the outside, which surface, when the wedge is in the locking position and the connection head is braced against the vertical scaffolding element, using the wedge, and/or when the wedge is in the locking position, lies against the vertical wedge support surface of the outer projection part only locally, preferably in the region of an upper recess edge of the recess of the projection, particularly in dot or line form, and that the wedge has a second wedge face edge that faces toward the inside in the transverse direction, which edge has a preferably essentially level vertical contact surface that faces toward the inside in the transverse direction, which surface corresponds to the vertical upper wedge support surface of the upper head part and to the vertical lower wedge support surface of the lower head part, in such a manner that the vertical contact surface of the wedge, lying against not only the vertical upper wedge support surface of the connection head but also against the vertical lower wedge support surface of the connection head, preferably over the full area, can be displaced not only relative to the vertical upper wedge support surface but also relative to the vertical lower wedge support surface, parallel to or along or in the direction of the vertical axis, only comparatively slight friction forces come about when the wedge is driven in, so that driving in of the wedge is possible in comparatively simple manner, particularly by means of a hammer blow. Furthermore, in this way it can be avoided that even after multiple driving in and releasing of the wedge, secure bracing of the connection head against the projection of the vertical scaffolding element or against the vertical scaffolding element is possible or guaranteed every time the wedge is driven in again.

Because of the fact that the slot is structured, in the direction toward its slot bottom and/or in the region of its slot bottom and/or in a rear region of the slot, with a shoulder of the upper head part that extends to below the horizontal upper slot surfaces of the slot configured in the introduction region for the projection, which shoulder is delimited, toward the bottom, by a horizontal upper slot surface of the slot, whereby the shoulder, which is disposed, in the support position, above the horizontal upper delimitation surfaces, is supported on the upper delimitation surface of the projection, over the full area, in the support position and at least when the wedge is in the locking position and the connection head is braced against the vertical scaffolding element, using the wedge, or already when the wedge is in the locking position, with its shoulder slot surface that extends parallel to the horizontal upper delimitation surface of the projection, so that the first distance of the upper end of the upper contact support surface of the upper head part from the horizontal center plane of the projection and the second distance of the lower end of the lower contact support surface of the lower head part from the horizontal center plane of the projection are equal in size, the same or symmetrical force and moment transfer conditions and, accordingly, the same static characteristic values of the connection during positive bending stress toward the top and negative bending stress toward the bottom can be achieved. Furthermore, defined contact, positioning, guidance and force transfer conditions can be implemented in this way. In particular, transverse forces can be better transferred from the connection head to the projection in this way. Furthermore, by means of the stated measures, the stresses in the connection head can be kept particularly low. Because of a reduced play between the slot and the projection projecting into it and the full-area contact conditions of the projection inserted into the slot, not only toward the bottom but also toward the top, the projection can be "entrained" well in the case of bending stresses not only toward the bottom and toward the top, if the scaffolding component, for example a scaffolding bar, that has the connection head is bent toward the top or toward the bottom, because the projection can now advantageously participate in the bending, not only toward the bottom but also toward the top, in such a manner that even greater bending forces or moments can be transferred, both toward the bottom and toward the top, than was the case until now. This design allows a connection node or a connection with better static characteristic values, overall.

According to a very preferred embodiment of the invention, it can be provided that the shoulder is disposed in the region of an imaginary vertical plane, particularly vertical plane of symmetry of the connection head, which is structured symmetrical to it, configured perpendicular to the horizontal center plane of the slot, extending in the longitudinal direction of the upper wedge opening, passing through the upper wedge opening. In this way, a further improvement in the sense of the above advantages can be achieved, and it is possible to implement a particularly advantageous combination with a or integration into a wedge support body disposed above the slot and engaging over the slot toward the front, within the scope of a further exemplary embodiment, which body has wedge support surfaces for vertical support of the lower wedge end of the wedge—to avoid or prevent unintentional movement of the wedge vertically downward into a blockage position, in which mounting of the connection head with its slot onto the projection, in an essentially horizontal mounting position, would be blocked—or to prevent unintentional movement of the wedge vertically downward, intersecting the slot, in order to allow mounting of the connection head with its slot onto the projection, in an essentially horizontal mounting direction, without blockage by the wedge.

Furthermore, it can be provided that the shoulder is configured on both sides of the vertical plane, containing the vertical plane, and/or that the shoulder extends continuously between upper side wall parts. Preferably, in this connection, the shoulder can be produced or connected in one piece with the upper side wall parts. In this way, a further improvement in the sense of the above advantages can be achieved, whereby simpler and easier mounting or pushing on of the connection head with its slot onto the projection is possible. By means of the measure last mentioned, a reinforcement, particularly of the upper head part, or the connection head can be achieved, so that the static characteristic values of the connection can be improved, as a whole.

According to a very particularly advantageous embodiment of the invention, it can be provided that the connection head is delimited by side wall parts that have vertical outer surfaces that run in wedge-like manner toward a center, particularly a central axis. The upper head part of the connection head can be delimited by upper vertical outer surfaces of upper side wall parts, preferably of the said side wall parts, which can be delimited by the horizontal upper slot surfaces of the slot that face toward the bottom. Preferably, the lower head part can be delimited by lower side wall parts, particularly of the said side wall parts, which can be delimited by the horizontal lower slot surfaces of the slot that face toward the top. Particularly preferably, the shoulder slot surface of the shoulder can be disposed to be offset toward the inside, in other words into the interior of the connection head. In this way, weight can be saved, and easier mounting or pushing on of the connection head onto the projection in a direction perpendicular to the transverse direction and perpendicular to the vertical axis or in the tangential direction is possible. This is particularly advantageous if mounting or pushing on of the connection head onto the projection in the direction toward the front or in the radial direction is not possible, for example because insufficient space is available for this, or because the scaffolding component is already fastened onto a projection of another vertical scaffolding element, at its end facing away from the connection head, particularly by means of a second connection head and a second wedge, by means of the second wedge that has been inserted through the perforation of this element, in such a manner that the scaffolding component can be pivoted in a horizontal plane relative to the projection.

The shoulder slot surface of the shoulder can be disposed offset toward the inside, in other words into the interior of the connection head, relative to the horizontal upper slot surfaces of the upper side wall parts. In this way, a further improvement in the sense of the above advantages can be achieved, and the connection head structured in this way can be produced in particularly simple and cost-advantageous manner.

According to a preferred further development, it can be provided that the shoulder can be provided with lateral introduction bevels. These can be provided, in each instance, with a slanted surface that extends, proceeding from the horizontal shoulder slot surface of the shoulder, at a slant toward the top and laterally toward the vertical outer surface, in each instance, of the upper side wall part, in each instance.

According to a particularly preferred embodiment of the invention, it can be provided that the shoulder is provided with a front introduction bevel. This can be provided with a slanted surface that extends, proceeding from a horizontal shoulder slot surface of the shoulder, at a slant toward the front or inside and top.

By means of these measures, mounting of the connection head with its horizontal slot onto the projection or insertion of the projection into the horizontal slot of the connection head is further simplified.

The aforementioned slanted surfaces can have an inclination angle relative to the horizontal or to the shoulder slot surface amounting to preferably about 10 to 30 degrees, particularly about 20 degrees.

According to a particularly preferred exemplary embodiment of the invention, it can be provided that the shoulder slot surface of the shoulder, with which the shoulder is supported, over its full area, on the upper delimitation surface of the projection, extends parallel to the horizontal center plane of the projection and/or parallel to the horizontal center plane of the slot. In this way, particularly advantageous positioning and alignment possibilities can be implemented, even over a long period of use.

Preferably, the projection is configured in plate shape or disk shape and/or the upper delimitation surface and the lower delimitation surface of the projection can be configured to run parallel to one another, preferably essentially level. This allows simple mounting of the connection head onto the projection and simple removal again of the connection head from the projection, and as a result, very particularly advantageous connection possibilities as well as advantageous force and moment transfer conditions can be achieved, in cost-advantageous manner, at low weight.

Furthermore, it can be provided that the shoulder slot surface of the shoulder that is supported over the full area on the top delimitation surface of the projection extends at a vertical first slot surface distance below the horizontal upper slot surfaces of the slot provided in the introduction region for the projection, and that the horizontal lower slot surfaces of the slot, which run parallel to the horizontal upper slot surfaces, extend at a vertical second slot surface distance below the lower delimitation surface of the projection that runs parallel to the upper delimitation surface, whereby the first slot surface distance is equal in size to the second slot surface distance. In this way, it can be ensured that the projection is better "activated" by the wedge not only during positive bending stress toward the top but also during negative bending stress toward the bottom, in other words that the forces are introduced equally well into the projection from the connection head in both stress directions, mainly by way of the wedge.

According to a particularly preferred embodiment variant, it can be provided that the horizontal upper slot surfaces of the upper head part and the horizontal lower slot surfaces of the lower head part extend on both sides of the horizontal center plane of the slot, at a distance corresponding to a first slot height, parallel to one another, which has a distance corresponding to essentially half the first slot height, and that the first distance of the upper end of the upper contact support surface of the upper head part from the horizontal center plane of the slot and the second distance of the lower end of the lower contact support surface of the lower head part from the horizontal center plane of the slot are equal in size. In this way, even further improved static characteristic values of the connection or of the connection node can be achieved. Also, in this way, calculation of the design of the connection head or of the connection node can be further simplified.

According to a particularly preferred embodiment, it can be provided that the horizontal center plane of the slot and the horizontal center plane of the projection essentially coincide or form a common plane in the support position. In this way, a further improvement in the sense of the above advantages can be achieved.

According to a preferred embodiment, it can be provided that the upper contact support surface of the upper head part and the lower contact support surface of the lower head part are equal in size. In this manner, very particularly advantageous force and moment transfer conditions can be implemented, thereby making it possible to achieve static characteristic values of the connection that are essentially equal in size not only during positive but also during negative bending stress.

A further improvement in the sense of the above advantages can be achieved if the upper contact support surface of the upper head part and the lower contact support surface of the lower head part are configured symmetrical to the horizontal center plane of the projection and/or symmetrical to the horizontal center plane of the slot.

Unless indicated otherwise, the direction information "toward the rear" is intended to mean a direction transverse, particularly radial to the longitudinal axis of the vertical scaffolding element, away from it or opposite to the mounting direction, in which the connection head is mounted onto the projection with its slot, with its contact support surfaces leading. Unless indicated otherwise, the direction information "toward the front" is intended to mean a direction transverse, particularly radial to the longitudinal axis of the vertical scaffolding element, toward it or in the mounting direction, in which the connection head is mounted onto the projection with its slot, with its contact support surfaces leading.

Unless indicated otherwise, the direction information "toward the outside" is intended to mean a direction transverse, in other words a transverse direction, relative to the longitudinal axis of the scaffolding element, away from the latter. Unless indicated otherwise, the direction information "toward the inside" is intended to mean a direction transverse, in other words a transverse direction, relative to the longitudinal axis of the scaffolding element, toward the latter.

The vertical axis can preferably be disposed parallel to the vertical or plumb line.

The scaffolding component can be a rod element, particularly a scaffolding tube and/or a scaffolding bar or a bracket. The scaffolding component can be provided with at least two connection heads that can be structured to be the same or different. The connection heads can be provided at ends of the scaffolding component that face away from one another. The scaffolding component can be formed with a profile, for example with an O or U cross-section, with a rod element or with a tube, particularly a round tube, which can be connected with the connection head in one piece or multiple pieces, particularly by means of welding.

The vertical scaffolding element can be a preferably cylindrical scaffolding tube, particularly a round tube in the form of a circular cylinder. The vertical scaffolding element can be a component, for example a sleeve or a tube section, that can be fastened onto a scaffolding post or pillar. The vertical scaffolding element can be a scaffolding post or pillar or a frame composed of or formed from these, for example an assembly frame or facade frame.

The projection can extend perpendicular and/or radial to the longitudinal axis of the vertical scaffolding element.

The projection can surround the vertical scaffolding element, in whole or in part. The projection can be a rosette, preferably a perforated disk. This can be provided, in known manner, with multiple recesses, particularly in the form of passage holes. These can be disposed, once again in known manner, at equal circumference angles, preferably of 45 degrees, relative to one another. Furthermore, small and large recesses can be provided, also in known manner, which can preferably be disposed alternately in the circumference direction.

Preferably, the scaffolding component and/or the connection head and/or the scaffolding element and/or the projection and/or the wedge consist(s) of metal. The connection head can preferably consist of a tempered casting, steel casting, or aluminum. The scaffolding component and/or the scaffolding element and/or the projection and/or the wedge can consist of steel, particularly of zinc-plated steel, or of aluminum. According to a particularly preferred combination, it can be provided that the projection and the vertical scaffolding element and the wedge consist of preferably zinc-plated steel, and that the connection head consists of a steel casting or tempered casting.

Preferably, the connection head can be delimited by side wall parts that have vertical outer surfaces that run toward a center, in wedge-like manner. The vertical outer surfaces can enclose a wedge angle that amounts to preferably 40 to 50 degrees, particularly about 43 to 46 degrees, preferentially about 44 degrees or 45 degrees.

The connection head can have a connection part that is firmly connected with the scaffolding component. The slot of the connection head can preferably reach all the way to the connection part.

If the connection head is delimited with side wall parts that have vertical outer surfaces that run in wedge-like manner toward a center, the slot can be open not only toward the contact support surfaces or toward the contact side, in other words toward the front, but also can be open toward the vertical outer surfaces.

Preferably, the wedge consists of flat material and has an essentially constant wedge thickness. Preferably, the wedge is undetachably connected with the connection head. For this purpose, the wedge can be provided with a retainer, or a retainer, in each instance, in the region of one of its wedge ends or in the region of its two wedge ends or on one wedge end or on both wedge ends. This retainer can be formed with a thickening. A pin or a rivet can be provided as a retainer. Preferably, the wedge can consist of flat material, in known manner, and can be provided with a rivet on its lower wedge end, which rivet can project laterally or transversely beyond the flat material of the wedge with at least one rivet head.

Preferably, the upper wedge opening can be structured as a longitudinal slot that extends from the rear toward the front, particularly containing the vertical plane. Preferably, the wedge opening can, or the longitudinal slot can have parallel slot walls that can run on both sides of the vertical plane. The slot walls can have a distance from one another that corresponds to the slot width. This distance or the slot width is preferably only slightly greater than the wedge thickness of the wedge, so that the wedge is then guided in the wedge opening with only slight lateral play.

The connection head and the scaffolding component can be connected with one another in multiple pieces or one piece. The scaffolding component and the connection head can have been or be produced in one piece or from one piece. The connection head can be formed onto the scaffolding component.

At least two of the subsequent parts of the connection head, if they are present, can be produced or can have been produced from one piece, in any desired combination: the upper head part, the lower head part, the contact part, the connection part, the wedge support body, the shoulder and/or the wedge pivot counter-bearing.

Using a connection head according to the invention, having a wedge according to the invention, for formation of an arrangement according to the invention or a releasable connection, a particularly advantageous method for fastening of a scaffolding component having at least one connection head onto a vertical scaffolding element can be implemented, which method, just like a scaffolding component having at least one connection head, is the object of a German patent application of the same applicant, having the title "Scaffolding component having at least one connection head and method for fastening a scaffolding component having at least one connection head onto a vertical scaffolding component," which was filed with the German Patent and Trademark Office on the same filing date as the present patent application. The content of this German patent application is being incorporated into the present patent application at this point, by making reference to them or referring to them, with their full content, for the sake of simplicity and in order to avoid repetition. Accordingly, the content of the said German patent application, with all the technical characteristics, both individually and in any desired combination, is therefore supposed to be completely included in the disclosure of the invention of the present patent application.

Further characteristics, advantages, and aspects of the invention can be derived from the following description part, in which advantageous exemplary embodiments of the invention are described using the figures.

Figure 2:
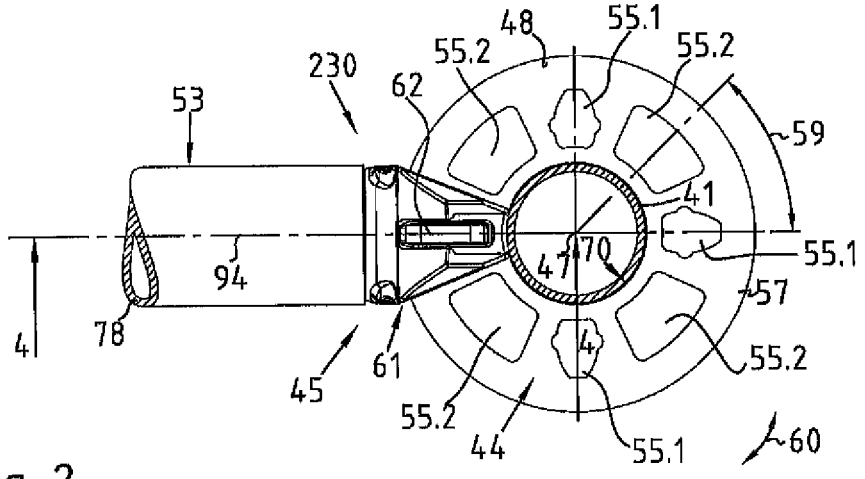
Figure 3:
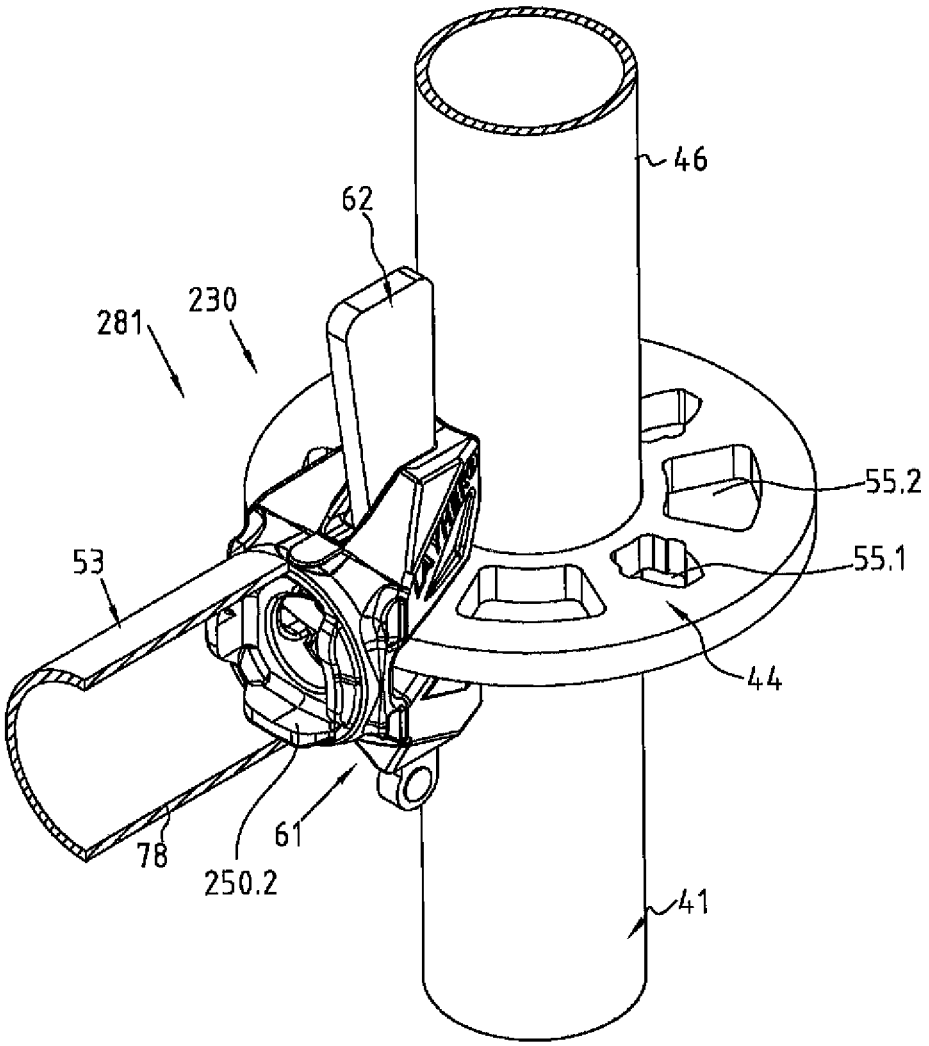
Figure 4:
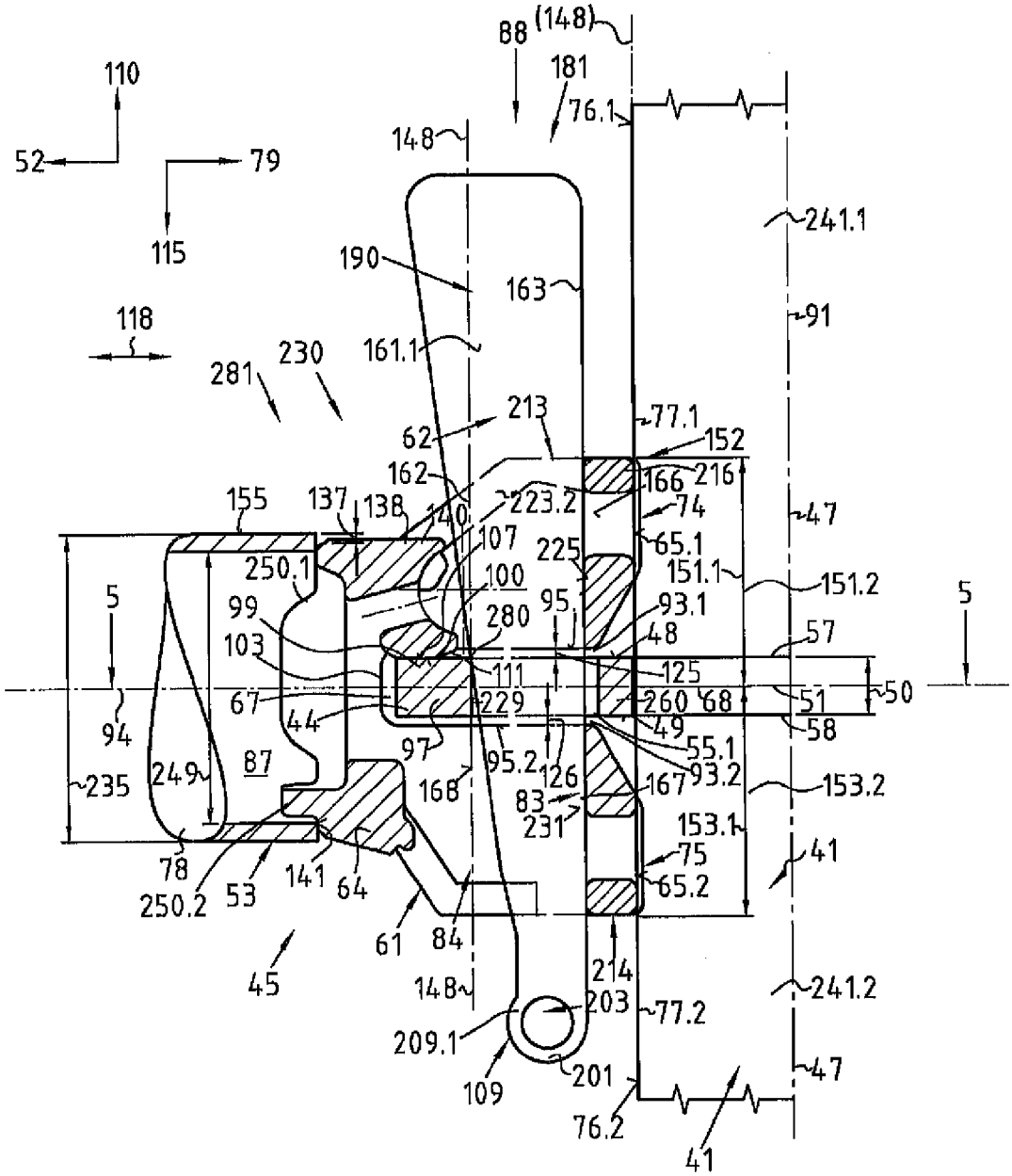
Figure 5:
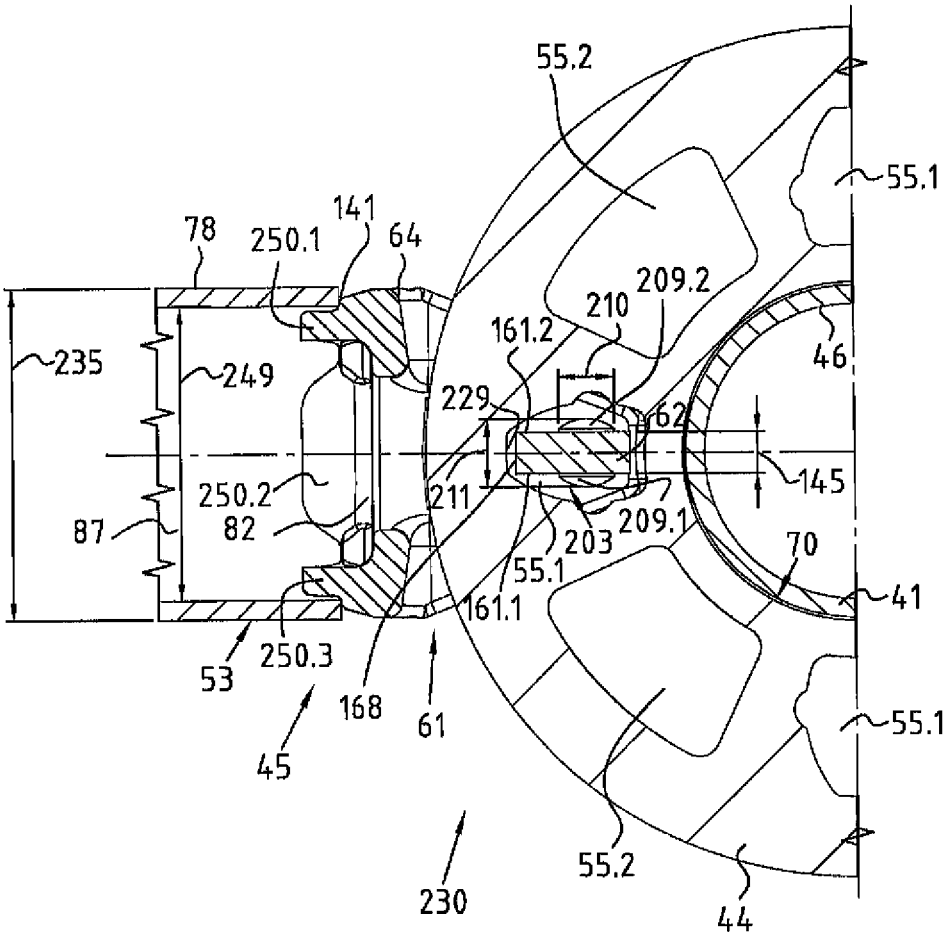
Figure 6:
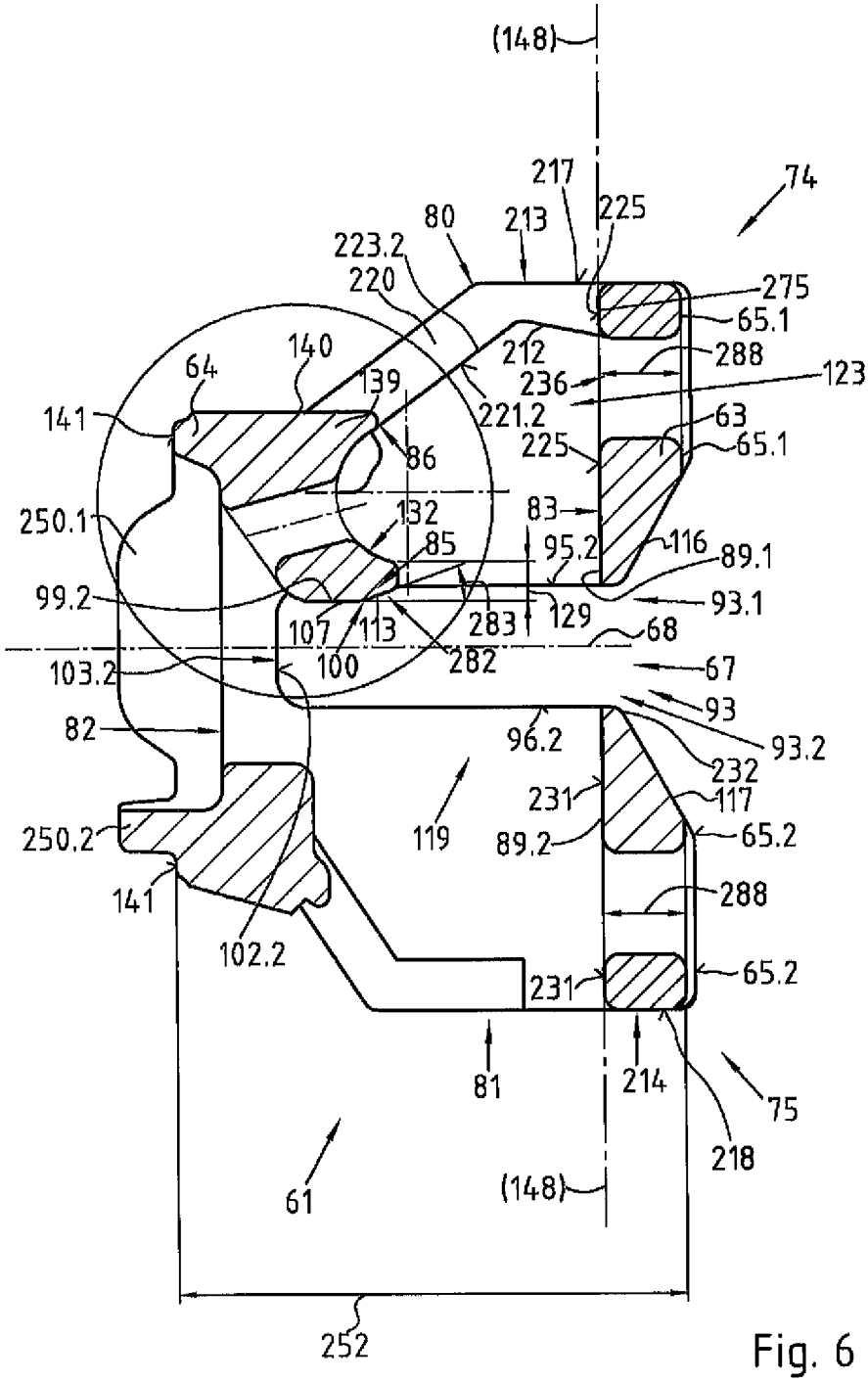
Figure 7:
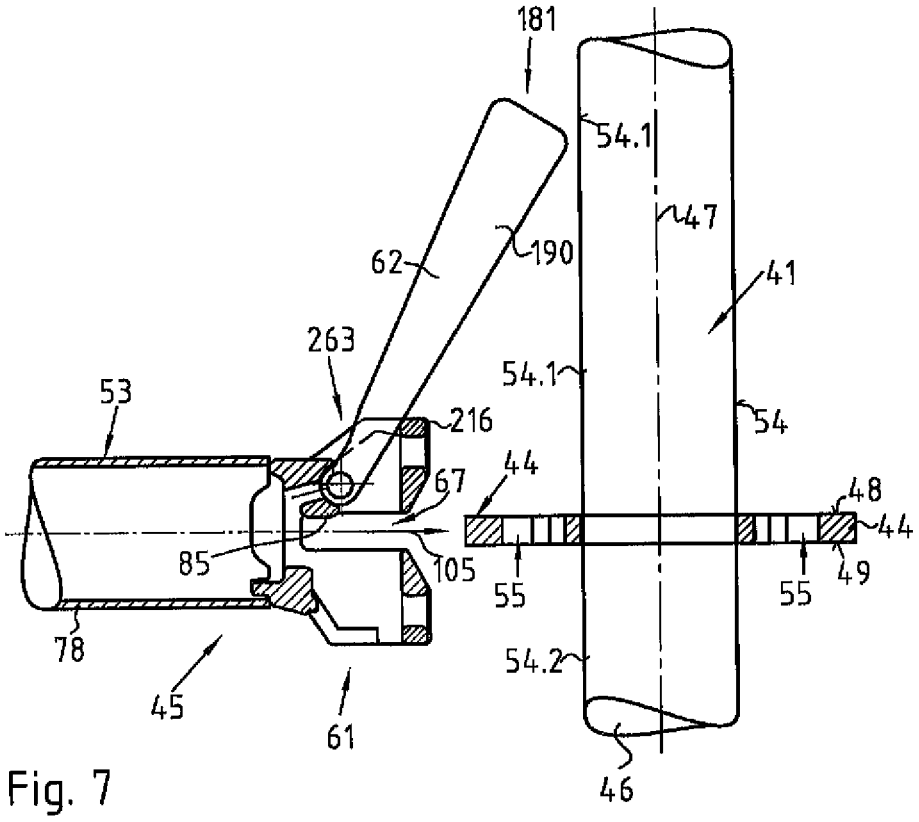
Figure 8:
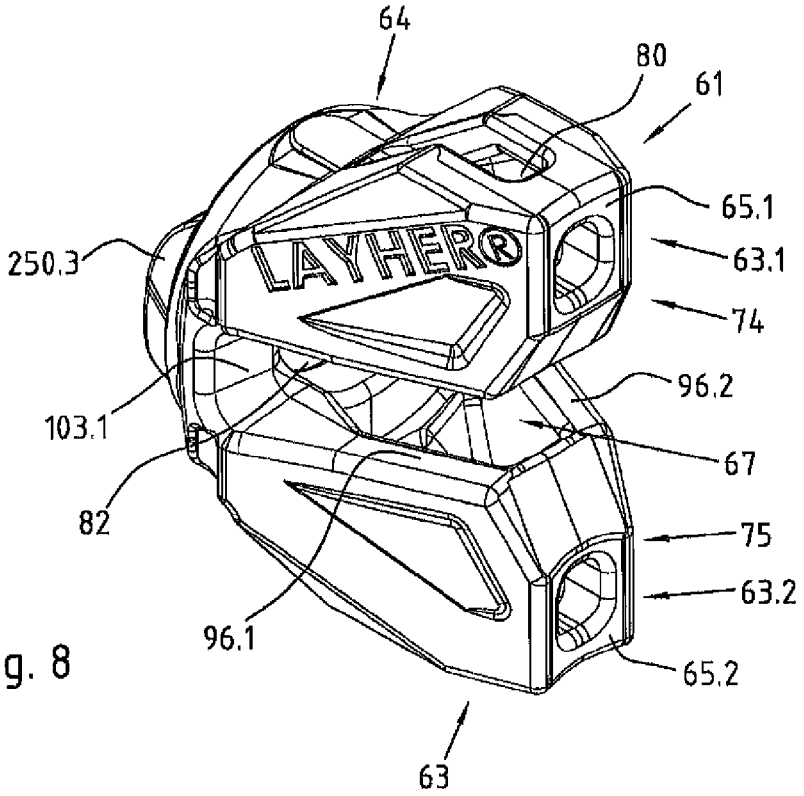
Figure 9:
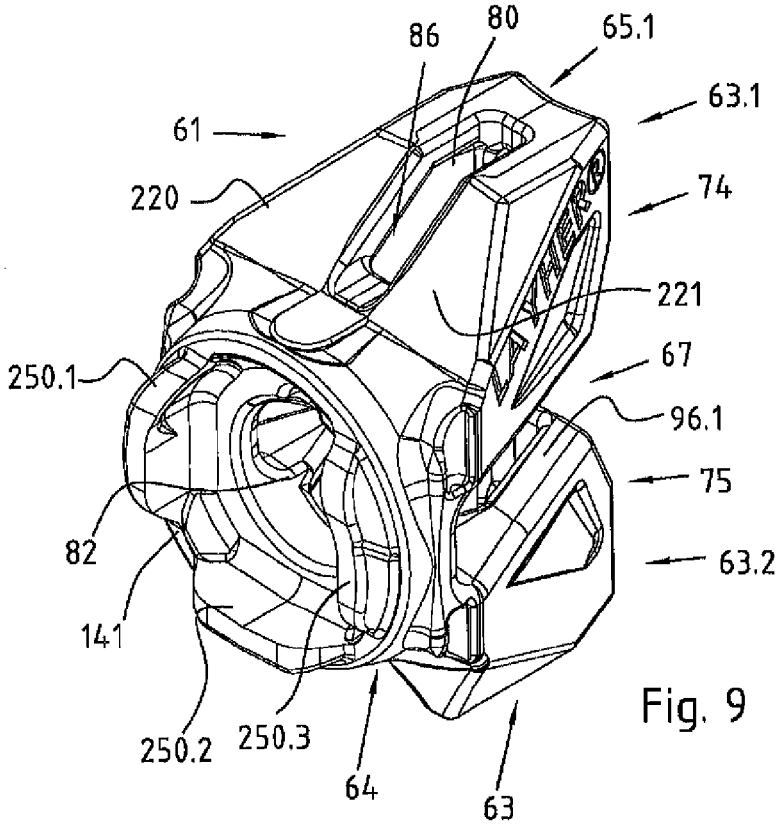
Figure 10:
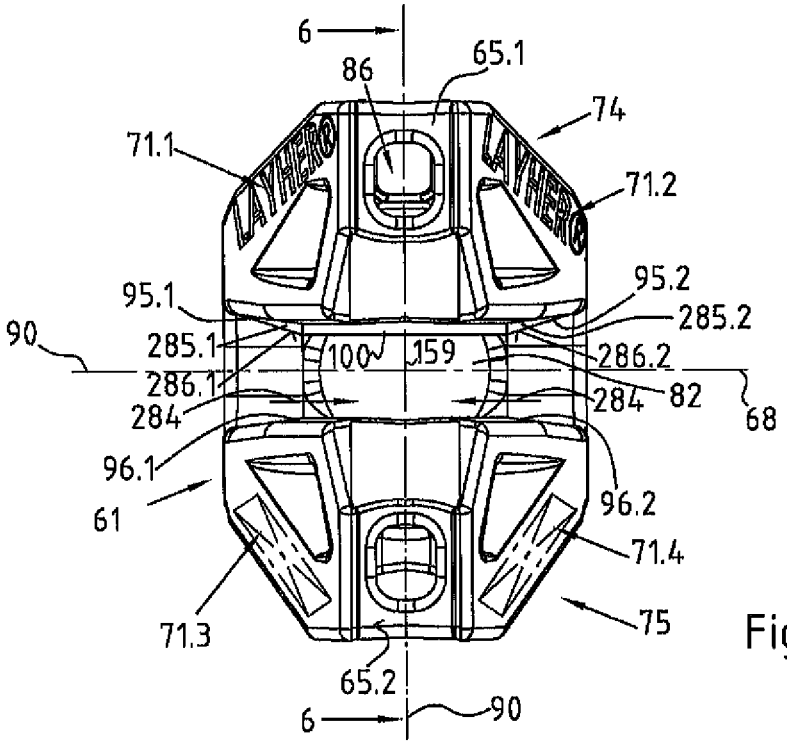
Figure 11:
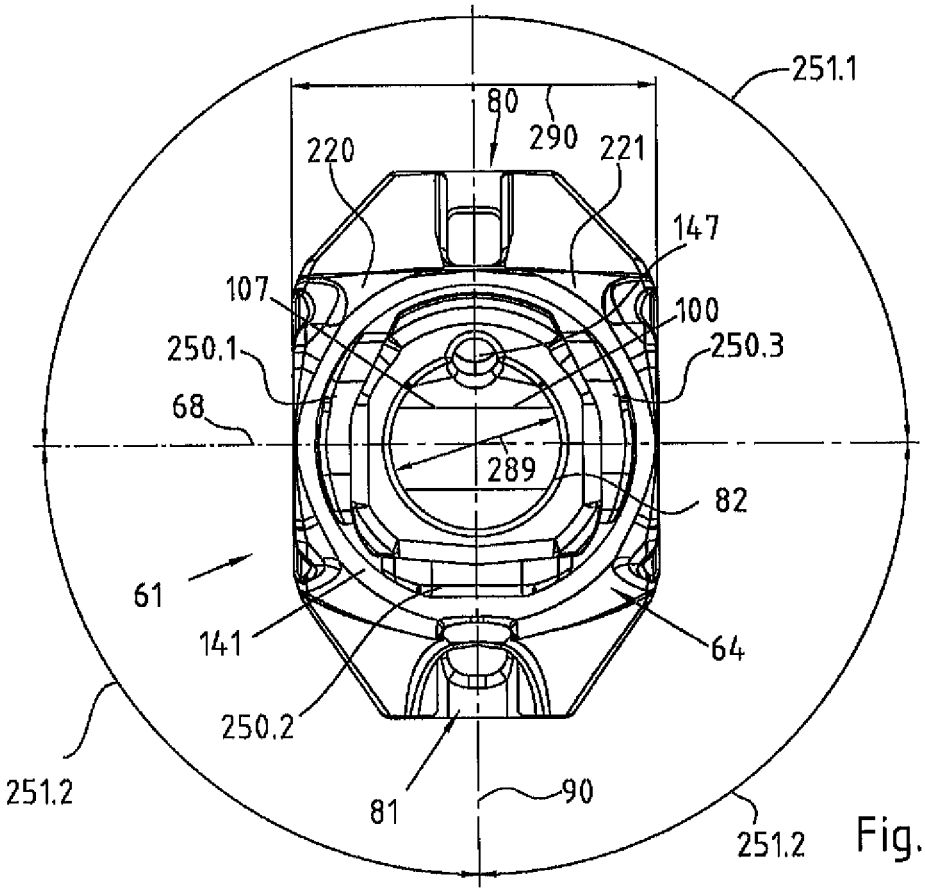
Figure 12:
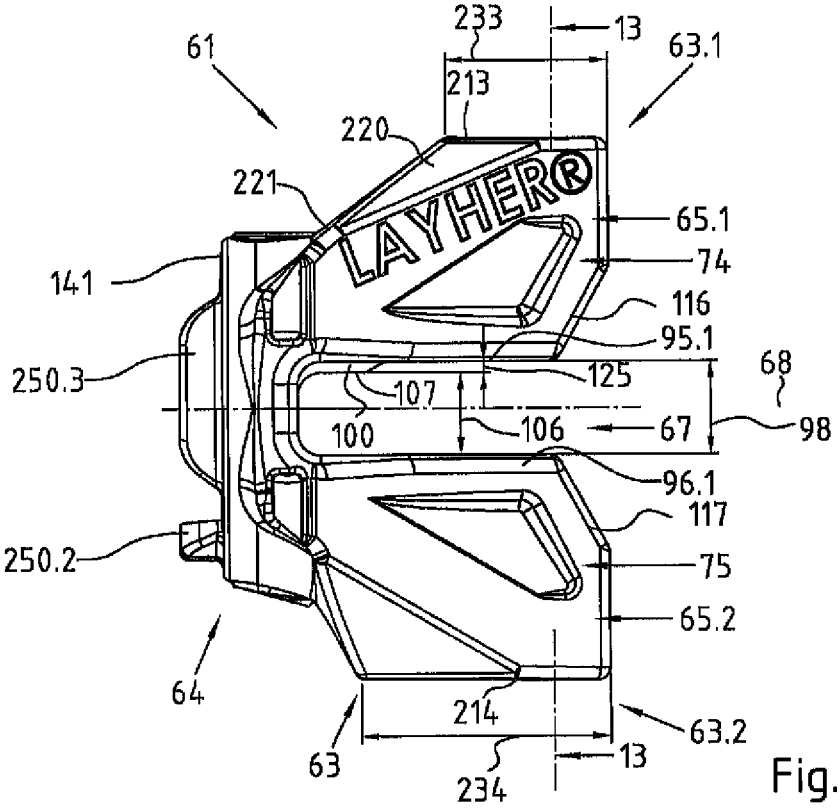
Figure 13:
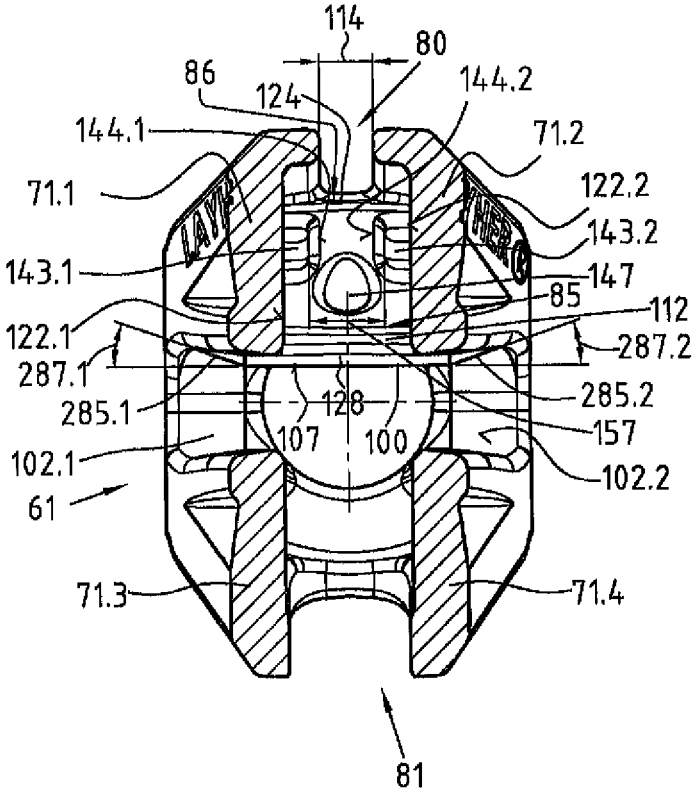
Figure 14:
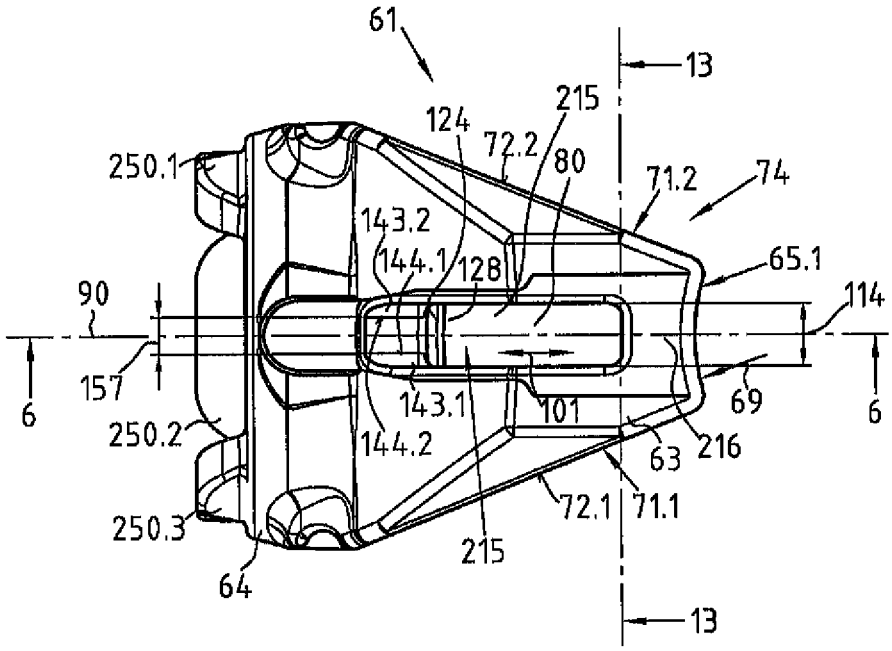
Figure 15:
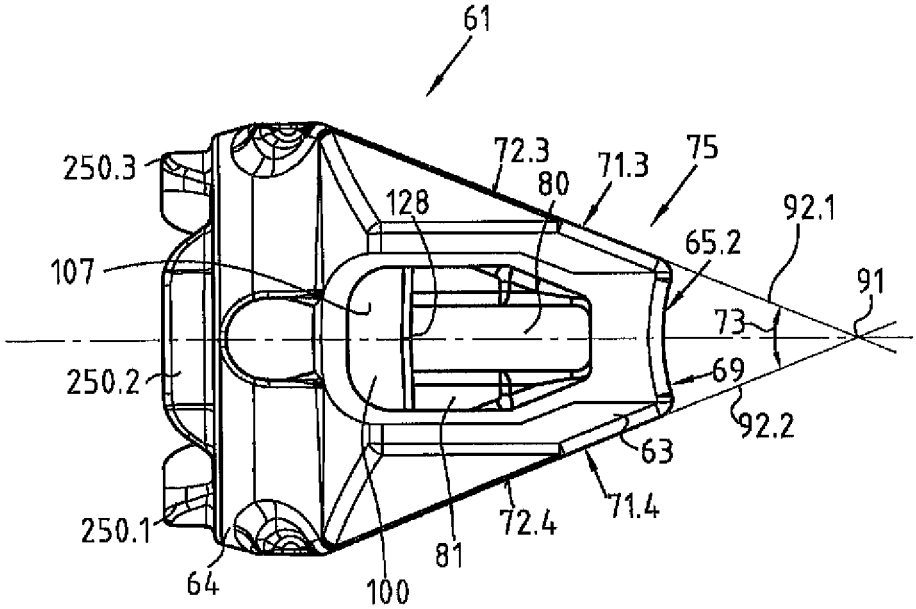
Figure 16:
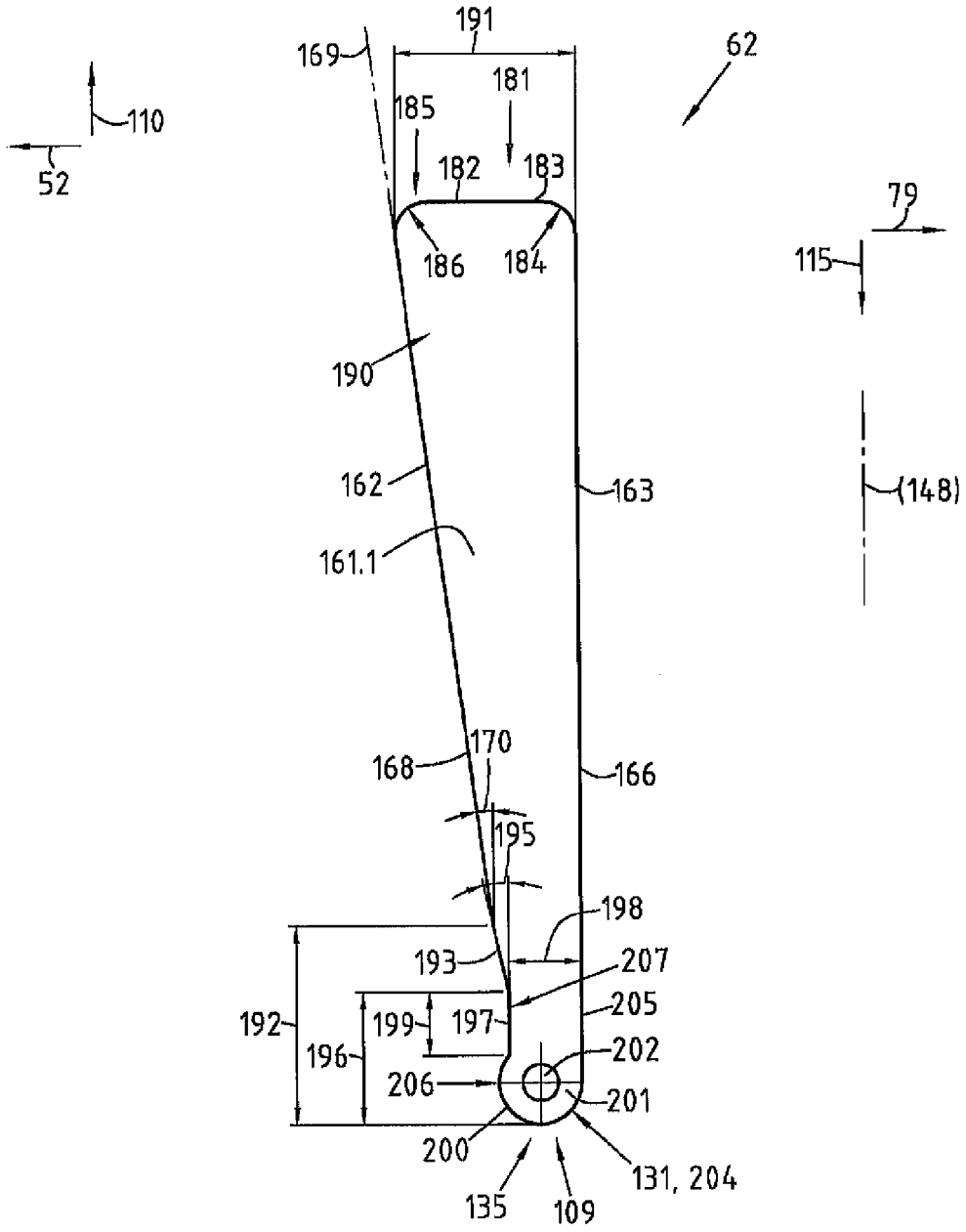

These show:

FIG. 1 A section of a scaffolding having scaffolding arrangements or components according to the invention, in a construction phase, in which an installer standing on a scaffolding deck, in a secured position, is in the process of fastening a scaffolding component according to the invention, for the formation of a leading railing, onto a perforated disk of a scaffolding post, using one of its connection heads according to the invention;

FIG. 2 an enlarged top view of an arrangement, according to the invention, of scaffolding parts according to the invention, with a partial section of a scaffolding post also referred to as a vertical scaffolding element, along the section lines 2-2 in FIG. 1;

FIG. 3 a three-dimensional view of a section of an arrangement according to the invention or of a connection node according to the invention, whereby a scaffolding component according to the invention is shown in partial section;

FIG. 4 the arrangement according to the invention or the connection node according to the invention, according to FIG. 3, in longitudinal section along the section lines 4-4 in FIG. 2;

FIG. 5 the arrangement or the connection node in horizontal section along the section lines 5-5 in FIG. 4;

FIG. 6 an enlarged longitudinal section of the connection head along the section lines 6-6 in FIGS. 10 and 14;

FIG. 7 an arrangement that contains the scaffolding component and a vertical scaffolding element in the form of a scaffolding post provided with a perforated disk, whereby an end region of the scaffolding component is shown in a horizontal starting position, proceeding from which the scaffolding component can be radially mounted onto the perforated disk, also referred to as a projection, of the scaffolding post shown with a post section, whereby the wedge is supported on wedge support surfaces of a wedge support body, above the slot, with its lower wedge end;

FIGS. 8 to 15 three-dimensional representations of the connection head according to the invention, whereby FIG. 8 shows a view of the connection head at a slant from the front, right, and top, FIG. 9 shows a view of the connection head at a slant from the rear, right, and top, FIG. 10 shows a front view of the connection head, FIG. 11 shows a rear or back view of the connection head, FIG. 12 shows a side view of the connection head from the right, FIG. 13 shows the connection head according to FIG. 10 in a cross-section along the section lines 13-13 in FIGS. 12 and 14, FIG. 14 shows a top view of the connection head, and FIG. 15 shows a bottom view of the connection head;

FIG. 16 a side view of a wedge according to the invention.

In FIG. 1, a section of a scaffolding 40, also called a modular scaffolding, is shown. The scaffolding 40 is constructed of vertical posts 41. The posts 41 form vertical scaffolding elements. Each post 41 extends vertically along an essentially straight longitudinal axis 47, in other words forms an essentially straight rod element 41. The posts 41 consist of metal, preferably of steel. However, the posts can also consist of light metal, particularly of aluminum or of aluminum alloys. The posts 41 are produced from round tubes 46. The round tubes 46 have an essentially cylindrical outer cross-section essentially over their entire effective length. Each post 41 has a tube, connector at one of its free ends, preferably at its upper end. The outside diameter of the tube connector is slightly smaller than the inside diameter of the post tube at the other end of the post 41, facing away from the tube connector, so that a further post 41 can be mounted onto the tube connector of a post 41. In this manner, the scaffolding 40 can be built up over multiple levels [no editing required here].

Multiple connection elements in the form of rosettes or perforated disks 44 are fastened onto the posts 41, spaced apart from one another in the axial direction 42, in other words in the direction of the longitudinal axes 47 of the posts 41, at a grid dimension 43 that preferably amounts to about 50 cm, preferably by means of welding, in order to be able to connect scaffolding components 45 in the form of connection, holding and/or support elements, for example longitudinal bars 45, transverse bars and/or diagonals there. The diagonals and the transverse bars are not shown in the figures. Scaffolding decks 269 can be fastened on top of or onto the transverse bars. Multiple scaffolding fields 270.1, 270.2 can be constructed. An installer 265 can install a scaffolding component 45 according to the invention from a position 266 secured to prevent him from falling down. In this connection, a leading railing 267 in the form of a hip or back railing 268 can be implemented.

The perforated disks 44 engage around the posts 41 over their full circumference, but can also engage around the posts 41 only in part. The perforated disks 44, which form a projection, extend transversely, in other words in the transverse direction 118 relative to the longitudinal axis 47 of the post 41, away from the outer surface 54 of the post 41, toward the outside 52. The perforated disks 44 are structured with upper and lower delimitation surfaces 48, 49, which are configured to run parallel to one another and to be essentially level. Accordingly, the perforated disks 44 have an essentially constant perforated disk thickness 50. The perforated disk thickness 50 preferably amounts to about 9 mm, particularly if the perforated disk 44 consists of steel. The perforated disk thickness 50 can, however, also be slightly greater, for example can amount to about 10 mm, particularly if the perforated disk 44 consists of light metal, for example of aluminum. The delimitation surfaces 48, 49 of the perforated disk 44 are configured parallel to an imaginary center plane 51 of the perforated disk 44, which intersects the perforated disk 44, viewed in the vertical direction or in the thickness direction 42, [commas already included in the English] at the height of half the perforated disk thickness 50. Each perforated disk 44 extends in a direction 52 perpendicular to the longitudinal axis 47 of the post 41, away from the latter, from the outer surface 54 of the post 41 radially toward the outside 52. Accordingly, the center plane 51 of the perforated disk 44 runs normal to the longitudinal axis 47 of the post. Each perforated disk 44 is provided, in usual manner, with multiple passage holes 55, which are also referred to as perforations 55. This means that each of these passage holes 55 is laterally delimited, over its entire circumference, by wall parts of the perforated disk 44. Each passage hole 55 extends, in the vertical direction 42, between the upper delimitation surface 48 formed on the top side 57 of the perforated disk 44 and the lower delimitation surface 49 on the underside 58 of the perforated disk 44. The passage holes 55 are disposed, in known manner, to be spaced apart from one another at equal circumference angles 59 of 45 degrees, in each instance. Furthermore, also in known manner, small and large perforations 55.1, 55.2 are provided, which are disposed alternately in the circumference direction 60. The precise configuration of the perforated disk 44 is particularly evident from FIGS. 3 to 5. The perforated disks 44 preferably consist of steel, but can also consist of light metal, particularly of aluminum or aluminum alloys.

The scaffolding 40 shown in the figures is constructed with scaffolding components 45 according to the invention, in the form of longitudinal bars 45 and transverse bars, as well as diagonals, whereby only the longitudinal bars 45 are shown in the figures. These bars 45 are configured to be completely compatible with the previously known bars and consequently fully compatible with the previous LAYHER Allround modular scaffolding system. This means that the bars 45 according to the invention can easily be combined with the previous other scaffolding parts of this previous modular scaffolding system.

The scaffolding bars 45 according to the invention have a connection had 61 according to the invention at their ends 56.1, 56.2 that face away from one another, in each instance, by means of which head the scaffolding bar 45 can be fastened onto a perforated disk 44 assigned to it, in each instance. For this purpose, each connection head 61 has a wedge 62 that is undetachably connected with the connection head 61, by means of which wedge the connection head 61, in each instance, can be wedged in place on a perforated disk 44 assigned to it. The connection heads 61 can be fastened onto a rod element 53 of the scaffolding bar 45 as separately produced components. The scaffolding bars 45 shown in the figures are produced in multiple parts or from multiple parts, namely from two connection heads 61 and from one rod element 53, in each instance. In the exemplary embodiments shown, a round tube 58 made of metal, preferably of steel, is used as the rod element 53. It is understood, however, that the invention is not restricted to rod elements, particularly not to such rod elements. Thus, other profiles, for example U-profiles, can be used as rod elements, in place of round tubes. Instead of being fastened onto rod elements 53, the connection heads 61 according to the invention can also be fastened onto other components. For example, a scaffolding component 45 according to the invention can also be a bracket having one or having multiple connection heads according to the invention.

In the exemplary embodiment, the round tube 78 is welded to the connection head 61, in each instance, as usual. It is understood, however, that a connection head according to the invention can also be fastened onto a component of the scaffolding component according to the invention in different manner. It is furthermore understood that a scaffolding component according to the invention can also be produced in one piece with at least one connection head according to the invention.

Each connection head 61 has a contact part 63 and a connection part 64. The connection part 64 is firmly connected with the round tube 78, preferably by means of welding. The contact part 63 has contact wall parts 63.1, 63.2 having contact support surfaces 65.1, 65.2, for making contact with the corresponding outer surfaces 54 of the post 41. These contact support surfaces 65.1, 65.2 are concavely rounded, viewed in horizontal section parallel to the center plane 68 of the slot 67, with a radius 69 that corresponds to the outer radius 70 of the round tube 46 of the post 41.

Each connection head 61 is delimited by side wall parts 71.1 to 71.4 that have vertical outer surfaces 72.1 to 72.4 that run, in wedge-like manner, toward a center or toward a central axis 91, in the direction toward the front 79. The vertical outer surfaces 72.1 to 72.4 enclose a wedge angle 73 that preferably amounts to about 44 degrees or 45 degrees [no change required due to insertion of comma].

The contact part 63 comprises an upper head part 74 and a lower head part 75. The upper head part 74 has an upper contact support surface 65.1 of the contact support surfaces 65.1, 65.2 for making contact with a corresponding upper outer surface 76.1 of a post part 77.1 of the post 41 that extends above the projection 44. The lower head part 75 has a lower contact support surface 65.2 of the contact support surfaces 65.1, 65.2 for making contact with a corresponding lower outer surface 76.2 of a post part 77.2 of the post 41 that extends below the projection 44.

The upper head part 74 has an upper wedge opening 80, and the lower head part 75 has a lower wedge opening 81, for the wedge 62 that can be inserted through the wedge openings 80, 81.

A horizontal slot 67 that is open toward the contact support surfaces 65.1, 65.2, in other words toward the front 79, and also toward the vertical outer surfaces 72.1 to 72.4, in other words toward both sides, is disposed between the upper head part 74 and the lower head part 75, with which slot the connection head 61 can be mounted or has been mounted onto the perforated disk 44. The slot 67 preferably reaches all the way to the connection part 64 in the direction toward the rear.

A wedge accommodation space 84 for the wedge, also referred to as a passage 84, is configured between the upper wedge opening 80 and the lower wedge opening 81, which space extends through the upper head part 80 and through the lower head part 81, crossing the slot 67. The wedge accommodation space 84 or the passage 84 is delimited, toward the front 79, by the contact wall part 63.1 of the upper head part 74 and the contact wall part 63.2 of the lower head part 75, toward the sides by the side wall parts 71.1 to 71.4 of the upper and of the lower head part 74, 75, and toward the rear by the connection part 64, as well as by a wedge support body 85 and by a wedge pivot counter-bearing 86 in the upper head part 74, which will be discussed in greater detail below. The passage 84 or the wedge accommodation space 84 stands in a passage connection with a perforation 82 in the connection part 64. This in turn stands in a passage connection with the interior space 87 of the round tube 78. The perforation has an inside diameter 289 that preferably amounts to about 22.5 mm. The connection head 61 has a maximal width 290 in the region of a transition from the contact part 63 to the connection part 64. This width can preferably amount to about 48 to 49 mm.

When the connection head 61 is completely mounted onto the perforated disk 44 with its slot 67, and when the wedge 62 has been inserted through the passage 84 and through a perforation 55.1 of the perforations 55.1, 55.2 of the perforated disk 41, so that the connection head 61 of the scaffolding bar 45 is locked to the perforated disk 44, with shape fit, in a locking position 88 of the wedge 62, the upper wedge opening 80 of the upper head part 74 and the lower wedge opening 81 of the lower head part 75 approximately align with this perforation 55.1.

To unlock the connection head 61 locked to the perforated disk 44 from the perforated disk 44, the wedge 62 can be moved or pulled upward through the passage 84 or through the wedge opening 55.1, all the way to above the upper delimitation surface 48 of the perforated disk 44, so that then, the connection head 61 can be removed from the projection 44, in other words can be freely handled separately.

The connection head 61 is structured symmetrical to an imaginary vertical plane of symmetry 90, which is configured perpendicular to the imaginary horizontal center plane 68 of the slot 67. The vertical plane of symmetry 90 contains the imaginary vertical central axis 91, in which the vertical planes 92.1, 92.2 spanned by the vertical outer surfaces 72.1 to 72.4 of the side wall parts 71.1 to 71.4 intersect in front of the connection head 61. In the exemplary embodiment shown, the vertical plane of symmetry 90 also contains the longitudinal axis 94 of the round tube 78 of the scaffolding component 45 or scaffolding bar 45. When the connection head 61 is mounted onto the perforated disk 44 and is locked and braced in place there by means of the wedge 62, the vertical plane of symmetry 90 contains the longitudinal axis 47 of the vertical scaffolding element 41 or post 41. In the introduction region 93 of the slot 67, the connection head 61 is structured symmetrical to the center plane 68 of the slot 67 with its upper head part 74 and its lower head part 75. Accordingly, the upper contact support surface 65.1 of the upper head part 74 and the lower contact support surface 65.2 of the lower head part 75 are configured symmetrical to the horizontal center plane 68 of the slot 67, and furthermore, the upper contact support surface 65.1 of the upper head part 74 and the lower contact support surface 65.2 of the lower head part 75 are equal in size.

The slot 67 has a front introduction region 93, in which it is delimited, toward the top, with horizontal upper slot surfaces 95.1, 95.2 of the upper head part 74, and, toward the bottom, with horizontal lower slot surfaces 96.1, 96.2 of the lower head part 75, which run parallel to one another, preferably also parallel to the longitudinal axis 94 of the round tube 78. There, the slot 67, viewed in the vertical direction 42, has a first slot height 98 or first slot width that corresponds to the vertical distance between the upper slot surfaces 95.1, 95.2 of the upper head part 74 and the lower slot surfaces 96.1, 96.2 of the lower head part 75, in the introduction region 93. This distance 98 preferably amounts to about 12 mm. The said slot surfaces 95.1, 95.2, 96.1, 96.2 extend on both sides of an imaginary horizontal center plane 68 of the slot 67 that runs at the height of half the slot height 98 or the slot width.

The slot 67 is delimited, toward the rear, with slot surfaces 102.1, 202.2 of a slot bottom 103.1, 103.2, which surfaces extend vertically. In the region of the slot bottom 103.1, 103.2, respectively in a rear region of the slot 67, in which horizontal upper slot surfaces 99; 99.1, 99.2 of the slot 67 lie opposite an outer edge crosspiece 97 of the perforated disk 44, which is delimited, radially toward the inside 79, by the said perforation 55.1 of the perforated disk 44, when the connection head 61 is completely mounted onto the perforated disk 44 and is locked in place there by means of the wedge 62 that has been inserted through a perforation 55.1 of the perforations 55.1, 55.2, the upper head part 74 of the connection head 61 has a shoulder 100. The shoulder 100 extends, viewed in an imaginary vertical section plane 106 that is configured perpendicular to the horizontal center plane 68 of the slot 67, extending in the longitudinal direction 101 of the upper wedge opening 80, passing through the upper wedge opening 80, preferably running in the transverse center of the connection head 61, to below the upper slot surfaces 95.1, 95.2 configured in the introduction region 93, and delimits the slot 67 toward the bottom with its upper shoulder slot surface 107.

Because the shoulder 100 is disposed in the region of the imaginary vertical plane 90 that is configured perpendicular to the horizontal center plane 68 of the slot 67, extending in the longitudinal direction 101 of the upper wedge opening 80, passing through the upper wedge opening 80, preferably running in the transverse center of the connection head 61, particularly the vertical plane of symmetry 90 of the connection head 61, which is configured to be symmetrical to this plane, a particularly advantageous combination with a or integration into a wedge support body 85 that engages over the slot 67 toward the front, disposed above the slot 67, can be implemented. The wedge support body 85 has wedge support surfaces 108 for vertically supporting the lower wedge end 109 of the wedge 62 to prevent unintentional movement of the wedge 62 vertically downward, intersecting the slot 67, in order to allow mounting of the connection head 61 with its slot 67 radially onto the projection 44 or onto the perforated disk 44, in an essentially horizontal mounting direction 107, without blockage by the wedge 62.

The shoulder 100 is configured on both sides of the vertical plane 90, containing the said vertical plane 90, and extends passing through between the upper side wall parts 71.1, 71.2. In this way, further improvement in the sense of the above advantages can be achieved, whereby simple and easy mounting or pushing on of the connection head 61, with its slot 67, onto the projection 44 is possible. By means of the measure last mentioned, furthermore reinforcement, particularly of the upper head part 74 of the connection head 61 can be achieved, so that the static characteristic values of the connection or of the connection node can be improved, on the whole.

The shoulder 100 delimits the slot 67 toward the bottom 115 with the upper shoulder slot surface 107. The upper shoulder slot surface 107 is configured parallel to the upper slot surfaces 95.1, 95.2; 99.1, 99.2 and to the lower slot surfaces 96.1, 96.2 of the slot 67, or parallel to the horizontal center plane 107 of the slot 67. Between the upper shoulder slot surface 107 of the shoulder 100 and the lower slot surfaces 96.1, 96.2 of the slot 67, the slot width 106 or height of the slot 67, viewed in the vertical direction, is reduced, because of the shoulder 44, to a vertical distance 106 that is less than the distance 98 between the upper slot surfaces 95.1, 95.2 and the lower slot surfaces 96.1, 96.2 in the front introduction region 93 of the slot 67, and which is therefore less than the slot width 98 or height of the slot 67 in this introduction region 93. The said distance 106 between the shoulder slot surface 107 and the lower slot surfaces 96.1, 96.2 amounts to about 10.5 mm in the exemplary embodiment. The connection head 61 is supported vertically on the upper delimitation surface 48 of the outer edge crosspiece 97 of the perforated disk 44, over the full area, in a support position 281, by way of this shoulder 100, when the head is completely mounted onto the perforated disk 44 with its slot 67 and locked in place there by means of the wedge 62.

Because of the said shoulder 100, the slot 67, viewed in the direction from the front to the rear 52, is structured with a narrowing 111 in the direction toward the slot bottom 103.1, 103.2. The narrowing 111 or the shoulder 100 is formed by an upper wall part 112 of the upper head part 74. This upper wall part 112 extends horizontally and between the side wall parts 71.1, 71.2 of the upper head part 74, preferably continuously, as shown in the figures. The said upper wall part 112 or the shoulder 100 is delimited toward the front 79, in other words in the direction toward the introduction region 93 of the slot 67, by a slanted surface 113 of a front introduction bevel 282 that is inclined downward and toward the rear. The slanted surface 113 extends, viewed in a vertical section that contains the vertical plane of symmetry 90, from the upper slot surfaces 95.1, 95.2 of the introduction region 93, toward the bottom 115 and toward the rear or outside 52, toward the slot bottom 103.1, 103.2.

The slanted surface 113 encloses an inclination angle 283 with the horizontal 274 or with the shoulder slot surface 107 that preferably amounts to 20 degrees.

The contact wall part 63.1 of the upper head part 74 of the connection head 61 is structured, proceeding from its front contact support surfaces 65.1 toward the slot 67, with an upper introduction bevel 116 that is inclined toward the rear or outside 52 and toward the bottom 115. The contact wall part 63.2 of the lower head part 75 of the connection head 61 is structured, proceeding from its front contact support surfaces 65.2 toward the slot 67, with a lower introduction bevel 117 that is inclined toward the rear or outside 52 and toward the top 110. These two introduction bevels 116, 117 facilitate mounting of the connection head 61, with its slot 67, onto the perforated disk 44.

The upper introduction bevel 116 makes a transition, toward the rear 52, into the horizontal upper slot surfaces 95.1, 95.2 in the introduction region 93 of the slot 67. The lower introduction bevel 117 makes a transition, toward the rear 52, into the horizontal lower slot surfaces 96.1, 96.2 in the introduction region 93 of the slot 67. Because of the comparatively great slot height 98 or width of the slot 67 in the introduction region 93, the connection head 61, with its slot 67, can accordingly be easily mounted onto or pushed onto the perforated disk 44. Because of the slanted surface 113 of the shoulder 100 that is inclined toward the rear 52 and bottom 115, the connection head 61, when it is already radially mounted onto the perforated disk 44 with the introduction region 93, can easily be pushed further toward the front 79, radially 79 onto the perforated disk 44.

As is particularly evident from FIGS. 10 to 13, the shoulder slot surface 107 of the shoulder 100 is disposed offset relative to the vertical outer surfaces 72.1, 72.2 of the upper side wall parts 71.1, 71.2, in the direction 284 toward the inside, in other words into the interior 119 or into the inner space 123 of the connection head 61. In this connection, the shoulder slot surface of the shoulder 100 is disposed offset relative to the upper slot surfaces 95.1, 95.2; 99.1, 99.2 of the upper side wall parts 71.1, 71.2, in the direction 284 toward the inside. The shoulder 100 is furthermore provided with lateral introduction bevels 285.1, 285.2 that are provided, in each instance, with a slanted surface 286.1, 286.2 that extends toward the vertical outer surface 72.1, 72.2 of the upper side wall parts 71.1, 71.2, in each instance, and toward the bottom 115, which surface makes a transition into the horizontal shoulder slot surface 107 of the shoulder 67 in the direction 284 toward the inside.

By means of the above measures, individually or in any desired combination, weight can be saved, and easier mounting or pushing on of the connection head 61 also in a direction 120 perpendicular to the transverse direction 118, in other words lateral or tangential to the projection 44, is possible. This is particularly advantageous if for mounting or pushing on of the connection head 61 in the direction radially toward the front 79, onto the projection 44 or onto the perforated disk 44 is not possible, for example because insufficient space is available for this, or because the scaffolding component 45 or the scaffolding bar 45 is already fastened onto a projection 44 or onto a perforated disk 44 of another vertical scaffolding element 41, at its end 56.2 facing away from the connection head 61, particularly by means of a second connection head 61 and a second wedge 62, by means of the second wedge 62 inserted through a perforation 55.1 of the perforated disk 44, in such a manner that the scaffolding component 45 or the scaffolding bar 45 can be pivoted in a horizontal plane 121 relative to the projection 44 or to the perforated disk 44. Such an installation position is indicated in FIG. 1, and will be discussed in further detail below. The connection head 61 that is structured in this way can be produced in particularly simple and cost-advantageous manner.

As is particularly evident from FIGS. 10 and 13, the shoulder 100 extends between the upper side wall parts 71.1, 71.2, passing through the inside space 123 spanned by these parts or by their inner delimitation surfaces 122.1, 122.2. In this way, simple and easy mounting or pushing on of the connection head 61, with its slot 67, onto the projection 44 is possible, and reinforcement, particularly of the upper head part 74 of the connection head 61, can be achieved, so that the static characteristic values of the connection can be improved, as a whole.

The upper shoulder slot surface 107 of the shoulder 100 extends, viewed in vertical section parallel to the vertical plane of symmetry 90, at a vertical first slot surface distance 125 below the upper slot surfaces 95.1, 95.2 of the slot 67 provided in the introduction region 93. When the connection head 61 is supported on the upper delimitation surface 48 of the edge crosspiece 97 of the perforated disk 44, by way of the shoulder slot surface 107 of the shoulder 100, over the full area, the lower slot surfaces 96.1, 96.2 of the slot 67 extend at a vertical second slot surface distance 126 below the lower delimitation surface 49 of the edge crosspiece 97 of the projection 44. According to the invention, the first slot surface distance 125 is equal to the second slot surface distance 126. Preferably, the first slot surface distance 125 and the second slot surface distance 126 can amount to about 1.5 mm, in each instance. By means of this measure, a certain or slight play remains during mounting of the connection head 61, with its slot 67, onto the perforated disk 44, which play facilitates mounting. By means of the said measure, or by means of the special configuration of the shoulder 100, however, the result is also achieved that when the connection head 61, with its slot 67, is completely mounted onto the perforated disk 44, so that the connection head 61 is supported on the edge crosspiece 97 of the perforated disk 44, by way of the shoulder 100 on the top side 57 of the perforated disk 44, centering of the connection head 61 not only relative to the horizontal center plane 68 of the slot 67 but also relative to the horizontal center plane 51 of the perforated disk 44 is achieved. In other words, according to the invention, the result can be achieved or it can be provided not only that the first distance 151.1 of the upper end 152 of the upper contact support surface 65.1 of the upper head part 74 from the horizontal center plane 68 of the slot 67 and the second distance 153.1 of the lower end 154 of the lower contact support surface 65.2 of the lower head part 75 from the horizontal center plane 68 of the slot 67 are equal in size, but also that the first distance 151.2 of the upper end 152 of the upper contact support surface 65.1 of the upper head part 74 from the horizontal center plane 51 of the perforated disk 44 and the second distance 153.2 of the lower end 154 of the lower contact support surface 65.2 of the lower head part 75 from the horizontal center plane 51 of the perforated disk 44 are equal in size. In this way, the same lever arm conditions can be achieved at positive bending stresses toward the top as well as negative bending stresses toward the bottom, and, accordingly, improved static characteristic values of the connection or of the connection node can be achieved.

Both the first distance 151.1 of the upper end 152 of the upper contact support surface 65.1 of the upper head part 74 from the horizontal center plane 68 of the slot 67 and the second distance 153.1 of the lower end 154 of the lower contact support surface 65.2 of the lower head part 75 from the horizontal center plane 68 of the slot 67 amount to about 36 mm in the exemplary embodiment shown. Both the first distance 151.2 of the upper end 152 of the upper contact support surface 65.1 of the upper head part 74 from the horizontal center plane 51 of the perforated disk 44 and the second distance 153.2 of the lower end 154 of the lower contact support surface 65.2 of the lower head part 75 from the horizontal center plane 68 of the perforated disk amount to about 36 mm in the exemplary embodiment shown.

The wall part 112 of the upper head part 74 that contains the shoulder 100 extends horizontally and transversely between the upper side wall parts 71.1, 71.2 in the interior 123 of the connection head 61. The said wall part 112 furthermore extends toward the front, into the wedge accommodation space 123, delimiting same toward the rear. The said wall part 112 has a front delimitation edge 128 that is rounded in convex manner, viewed in a vertical section containing the vertical plane or the vertical plane of symmetry 90. This front delimitation surface 128 forms a release edge 128 for releasing the wedge, which will be discussed in greater detail below.

At the same time, the said wall part 112 or the body containing the shoulder 100 forms an inner wedge support body 85 for vertical support of the lower wedge end 109 of the wedge 62 in an installation position 263, in which position mounting of the connection head 61, with its slot 67, onto the perforated disk 44 is made possible without blockage by the wedge 62. The wedge support body 85 is disposed above the slot 67, engaging over the slot 67 toward the front 79. The wedge support body 85 has wedge support surfaces 108, on which the wedge 62 can be supported with its lower wedge end 109, in the said installation position 263. The wedge support surfaces 108 follow a front delimitation edge 128 of the shoulder 100 or of the said wall part 112, running toward the rear 52 and top 110. At least the wedge support surfaces 108 of the wedge support body 85 disposed in the region of or adjacent to the said delimitation edge 128 are disposed at a slight vertical distance 129 above the shoulder slot surface 107. This distance 129 is less than half the slot height 98 or width in the introduction region 93 of the slot 67. The wedge support surfaces 108 are inclined at a slant toward the front 79 and bottom 115 in the direction of the front delimitation edge 128 of the said wall part 112, and are structured to be concave, viewed in a vertical section containing the vertical plane of symmetry 90. In the exemplary embodiment shown, the wedge support surfaces 108, viewed in the said vertical section, are structured with an inner radius 130 that preferably amounts to about 7 mm. This inner radius 130 is slightly greater than the outer radius 131, which preferably amounts to about 6.25 mm, of the wedge end part 201 at the lower wedge end 109 of the wedge, which can be supported on the wedge support surfaces 108.

The said wedge support surfaces 108 delimit an accommodation pocket 132 for accommodation and support of the wedge end [change is a correction of a typo in the German that was already incorporated into the translation] part 201 on the lower wedge end 109 of the wedge 62, which part, as has already been mentioned, is rounded in convex manner with the said outer radius 131. Viewed in the vertical section containing the vertical plane of symmetry 90, the accommodation pocket 132 has an inside contour 133 that extends in circular shape over a circumference angle 134, preferably of about 160 degrees. The inside contour 133 of the accommodation pocket 132 corresponds with an outside contour 135 of the wedge 62, which is also circular, on its lower wedge end 109. Viewed in the vertical section containing the plane of symmetry 90, the accommodation pocket 132 is delimited, toward the bottom 115 and front 79, by the lower, front delimitation edge 128 of the wedge support body 85 or of the shoulder 100. The accommodation pocket 132 is delimited toward the top 110 and front 79, by an upper front delimitation edge 124 of a wedge pivot counter-bearing 86, which preferably, at the same time, forms a wedge retainer body that delimits the wedge accommodation space 84 toward the rear 52. The wedge pivot counter-bearing 86 is therefore disposed above the wedge support surfaces 108 of the wedge support body 85 that allow vertical support of the wedge 62 at its lower wedge end 109.

When the wedge 62 is supported on the wedge support surfaces 108 of the wedge support body 85 at its lower wedge end 109, it projects, with a head part 190, out of the upper head part 74, out of the upper head part 74 of the connection head 61, and then furthermore projects toward the front or out, with an upper wedge end 181, beyond the connection head 61 or beyond its front, vertical contact support surfaces 61 or beyond the latter's front, vertical contact support surfaces 65.1, 65.2, as shown in FIG. 7, for example. As is also evident there, the wedge 62, in the installation position 263, in which it is supported on the wedge support surfaces 108 of the wedge support body 85, at its lower wedge end 109, by its own weight or as the result of gravity, can be pivoted relative to the connection head 61 in the imaginary longitudinal center plane of the wedge openings or in the imaginary vertical plane of symmetry 90 of the connection head 61, specifically all the way into an impact pivot position 261 inclined toward the front. In this impact pivot position 261, the wedge 62 is supported, with its front or second wedge face edge 163, on a wall part 216, which delimits the upper wedge opening 80 toward the front 79 or radially toward the inside, of the upper contact wall part 66.1 or of the upper horizontal wall part 213 of the upper head part 74.

When the wedge 62 is vertically supported on the wedge support surfaces 108 of the wedge support body 85, it can be laid against the wedge pivot counter-bearing 86 in the region of its lower wedge end 109. When the wedge 62 lies against the wedge pivot counter-bearing 86, vertically supported on the wedge support surfaces 108 of the wedge support body 85, the wedge 62 can be pivoted toward the rear 52 about the wedge pivot counter-bearing 86 with its wedge part 136 that projects out toward the top 110, beyond the upper wedge opening 80, and, at the same time, can be pivoted toward the front 79 with its lower wedge end 109, specifically all the way into a release position in which the lower wedge end 109 slips vertically toward the bottom 115 as the result of gravity or because of the inherent weight of the wedge 62, toward the front 79 beyond the lower, front delimitation edge 128 of the wedge support body 85 or the shoulder 100, also referred to as the release edge, so that the lower wedge end 109 moves into or through the slot 67 or while crossing the slot 67, all the into or through the lower wedge opening 81.

The front delimitation edge 124 of the wedge pivot counter-bearing 86 extends horizontally between the upper side wall parts 71.2, 71.2 of the upper head part 74, on both sides of the vertical plane of symmetry 90, preferably continuously. The front delimitation edge 124 of the wedge pivot counter-bearing 86 delimits the upper wedge opening 80 toward the rear 52. The wedge pivot counter-bearing 86, viewed in the vertical section containing the vertical plane of symmetry 90, is delimited, proceeding from its front delimitation edge 124, vertically toward the bottom 115, by an inner wall part 139 of the upper head part 74 that delimits the accommodation pocket 132, and, proceeding from its delimitation edge 124, is delimited toward the top 110 by an upper wall part 140 that extends horizontally from the upper head part 74 all the way to the upper contact wall part 63.1. The upper wall part 140 has a surface 138 that runs approximately parallel to the center plane 68 of the slot 67 or approximately parallel to the longitudinal axis 94 of the round tube 78 of the scaffolding component 45 or of the scaffolding bar 45. This surface, viewed in the vertical section containing the vertical plane of symmetry 90, is disposed at a slight distance 137 below the outer surface 155 of the round tube 78. The said surface 138 of the upper wall part 140 or the top side of the wedge pivot counter-bearing 86 has a vertical distance 156 from the shoulder slot surface 107 of the shoulder 100. This distance amounts to about 18.8 mm in the exemplary embodiment shown. The front delimitation edge 124 of the wedge pivot counter-bearing 86 has a horizontal distance 142 from the impact ring surface 141 of the connection part 64. This distance amounts to about 20 mm in the exemplary embodiment shown.

As is particularly evident from FIGS. 4, 6, and 13, the accommodation pocket 132 is delimited, in the region of its transverse center, containing the vertical plane of symmetry 90, in other words laterally, by two centering support tabs 143.1, 143.2. The centering support tabs 143.1, 143.2 have centering support surfaces 144.1, 144.2 that lie opposite one another, for the wedge 62. The wedge 62 is supported laterally between the centering support surfaces 144.1, 144.2, at its lower wedge end 109, with little play, when the wedge 62 is supported on the wedge support surfaces 144.1, 144.2 of the wedge support body 85 with its lower wedge end 109. In this way, lateral tilting of the wedge 62 that passes through the upper wedge opening 80, relative to the vertical plane of symmetry 90, can be minimized, and thereby the wedge 62, during movement of the connection head 61, with its slot 67, in a or the essentially horizontal mounting direction 105, toward the front 79, radially toward the projection 44 or toward the perforated disk 44, and also during mounting of the connection head 61, with its slot 67, toward the front 79, radially onto the projection 44 or onto the perforated disk 44, more precise or more secure activation and release of the wedge 62 can be achieved. The centering support surfaces 144.1, 144.2 of the centering support tabs 143.1, 143.2 extend at a horizontal distance 157 relative to one another. The distance 157 amounts to about 10 mm in the exemplary embodiment. This distance 157 is slightly greater than the thickness 145 of the wedge 62. The thickness 145 of the wedge 62 amounts to about 6 mm in the exemplary embodiment. The centering support tabs 143.1, 143.2 are disposed in an upper region 146 of the accommodation pocket 132, in other words in the region or in the vicinity of the wedge pivot counter-bearing 86. The centering support tabs 143.1, 143.2 extend toward the front 79 and bottom 115 into the wedge accommodation space 84. These two measures have proven to be particularly advantageous when the wedge 62 is supported, at its lower wedge end 109, on the wedge support surfaces 108 of the accommodation pocket 132 or of the wedge support body 85, in order to then achieve more secure guidance of the wedge 62 in the region of its lower wedge end 109, until its release.

A zinc run-out opening 147 opens into the accommodation pocket 132, preferably for the most part or essentially above the wedge support surfaces 108. This opening extends from the accommodation pocket 132 at a slant toward the rear 52 and bottom 115, at an inclination angle 136 relative to the vertical axis 148, all the way into a cavity 149 of the connection head 61, which stands in a passage connection with the perforation 82 in the connection part 64 of the connection head 61. In the exemplary embodiment shown, the inclination angle 136 amounts to about 75 degrees. The zinc run-out opening 147 has an inside diameter 150. This diameter amounts to about 6 mm in the exemplary embodiment shown. The zinc run-out opening 147 opens into the accommodation pocket 132, in a central region between the centering support surfaces 144.1, 144.2 of the centering support tabs 143.1, 143.2 and the wedge support surfaces 108. By means of the above measures, the zinc can flow out of the accommodation pocket 132 well in the case of zinc-plating of the connection head 61, so that no disruptive zinc collections can come about in this region. However, it is understood that in place of a central zinc run-out opening 147, at least two zinc run-out openings that open into the accommodation pocket 132 and are particularly disposed to the side of the vertical plane of symmetry 90, in each instance, can also be provided. These openings can be provided, for example, vertically below the centering support tabs 143 or in horizontally spaced apart edge regions of the upper side wall parts 71.1, 71.2, in each instance.

In the following, the wedge 62 according to the invention will be described in greater detail; it is shown separately in FIG. 16, in an installation position:

The wedge 62 consists of flat material, particularly of steel. It has an essentially constant wedge thickness 145. This thickness amounts to about 6 mm in the exemplary embodiment. The wedge 62 has parallel wedge side surfaces 161.1, 161.2 that face away from one another. The wedge 62 is delimited toward the rear 52 by a rear, first wedge face edge 162, and toward the front 79 by a front, second wedge face edge 163. The rear or first wedge face edge 162 is delimited by a rear, essentially level contact surface 168, which extends at a slant toward the bottom 115 and front 79 at an inclination angle 170 to a or the vertical axis 148. In the exemplary embodiment shown, the inclination angle 170 amounts to about eight degrees, particularly 7.7 degrees. The front or second wedge face edge 163 has an essentially level contact surface 166. The contact surface 166 of the front or second wedge face edge 163 faces toward the front 79, away from the rear or first wedge face edge 162 that faces toward the rear 52.

The vertical front contact surface 166 makes a transition, toward the top 110, with a rounding radius 184, preferably of about 5 mm, into an upper drive-in surface 183 on the upper wedge end 181 or drive-in end of the wedge 62. The upper wedge end 181 or drive-in end is formed by a horizontal upper wedge edge 182 that runs parallel to the vertical axis 148. This edge is delimited by the upper drive-in wedge surface 183 for driving in the wedge 62 with a hammer. The drive-in wedge surface 183 makes a transition, in the region of its rear upper end 185, particularly rounded with a radius 186 that also amounts to about 5 mm, for example, into the rear slanted contact surface 168 of the first wedge face edge 162. The upper wedge part 190 delimited by the slanted contact surface 168, the upper drive-in wedge surface 183, and the vertical contact surface 166 extends beyond the upper head part 74 of the connection head 61, vertically toward the top 110 (see also FIG. 4), when the connection head 61, with its slot 67, has been mounted onto the projection or onto the perforated disk 44 and locked and braced in a or the locking position 88. The upper wedge part 190 has a maximal wedge part width 191 in the region of the upper wedge end 181. This width amounts to about 27.5 mm in the exemplary embodiment. It is selected to be of such a size that the wedge 62, when the connection head 61 or the scaffolding component 45 having the connection head 61 is handled separately, and when the wedge 62 is inserted not only through the upper wedge opening 80 but also through the lower wedge opening 81, definitely cannot fall out downward through the lower wedge opening 81.

The wedge 62 has a length of about 140 mm. The vertical rear contact surface 168 makes a transition, at a distance 192 from the lower wedge end 109 that preferably amounts to about 33 mm, into a slanted surface 193 inclined toward the front 79 and bottom 115, which is configured at an inclination angle 195, which preferably amounts to about 13 degrees, relative to the vertical axis 148. The slanted surface 193 makes a transition into a vertical surface 197 of the rear or first wedge face edge 162 that runs parallel to the vertical axis 148, at a distance 196 from the lower wedge end 109 that preferably amounts to about 20 mm. There, the wedge 62 has a lower wedge width 198 between the vertical surfaces 197, 205 of the rear and the front wedge face edge 162 or 163, which run parallel there. This width amounts to about 11 mm in the exemplary embodiment. The said vertical surface 197 extends parallel to the vertical axis 148 over a length 199. This length amounts to about 10 mm in the exemplary embodiment. The vertical surface 197 makes a transition, toward the bottom 115, into a wedge end surface 200 of a wedge end part 201 that delimits the lower wedge end 109. In this part, a bore 202 for accommodating a retainer, here a rivet 203, is placed. The wedge end surface 200 of the lower wedge end part 201 is rounded with a radius 204 that is greater than half the lower wedge width 198, in which the wedge 62 is delimited by the rear vertical surface 197 of the rear or first wedge face edge 162 and by the front vertical surface 205 of the front or second wedge face edge 163, which surface runs parallel to the former surface. In a lower region, in which the wedge end surface 200 delimits the rear or first wedge face edge 162 toward the rear 52, the wedge end surface 200 rises slightly toward the rear 52, beyond the said rear vertical surface 197, so that an elevation 206 is configured there. The elevation 206, delimited by the rounded wedge end surface 200, the vertical surface 197 that follows it at a slant toward the top 110, and the slanted surface 193 that follows that at a slant toward the rear 52 and the top 110, delimit a bridging recess 207. This recess is provided for ensuring that the wedge 62, when it is inserted through the upper wedge opening 80 and undetachably secured and connected to the connection head 61 by means of the retainer 203, can easily be laid against the outer surface 155 of a rod element firmly connected with the connection head part 64 of the connection head 61, preferably of a round tube 78, after having been pulled upward or in a pulled-upward state, in which the retainer 203 prevents further pulling out of the wedge 62 toward the top, in the course of pivoting toward the rear 52 and bottom 115, until the wedge 62 makes contact, with its rear or first wedge face edge 162, in the region of the upper wedge end 181. In this manner, optimal space-saving accommodation of the wedge 62 for transport purposes is possible, and the risk of hooking onto other scaffolding components is minimized.

The rounded wedge end surface 200 of the lower wedge end part 201 makes a transition into the front contact surface 166 of the front or second wedge face edge 163, in a partial region assigned to the front, second wedge face edge 163, tangentially toward the top 110.

The wedge 62 is undetachably connected with the connection head 61. For this purpose, the wedge 62 has a retainer 203 in the form of a material thickening in the region of its lower wedge end 109, here on the wedge end part 201. In the exemplary embodiment, a rivet 203 is provided as the retainer. This rivet has rivet heads 209.1, 209.2 that project laterally beyond the level wedge side surfaces 161.1, 161.2 of the wedge 62. A truss-head rivet or a blind rivet, for example, can be used as the rivet 203. Preferably, the truss-head rivet can be riveted by machine, while the blind rivet can preferably be riveted by hand. The rivet heads 209.1, 209.2 span a maximal rivet head diameter 210 that is greater than the inside diameter of the accommodation bore 202 provided on the lower wedge end 109 of the wedge 62. Preferably, the maximal rivet head diameter 210 is less than twice the rounding radius 204 with which the lower wedge end part 201 is rounded (see, for example, FIGS. 4 and 7).

The rivet 203 projects laterally beyond the two wedge side surfaces 161.1, 161.2 of the wedge 62, with its rivet heads 209.1, 209.2, at a rivet width 211, which is greater than the slot width 114 of the upper wedge opening 80. As a result, the wedge 62 cannot be pulled out of the connection head 61 toward the top 110, but rather the wedge 62 can only be pulled upward up to an impact of at least one of its rivet heads 209.1, 209.2 against the inner delimitation surfaces 212 of the wall parts that delimit the upper wedge opening 80, particularly of the upper horizontal wall part 213, of the upper head part 74 of the connection head 61.

The lower wedge opening 81 of the lower head part 75 is larger than the upper wedge opening 80 of the upper head part 74, specifically so large that the lower wedge end 109, with the rivet 203 fastened in place there, can be inserted through the lower wedge opening 81, toward the bottom 115, without problems.

The upper wedge opening 80 structured as a longitudinal slot 215 extends on both sides of the vertical plane of symmetry 90 of the connection head 61. The longitudinal slot 215 has a slot width 114 that is only slightly greater than the thickness 145 of the wedge 62. The slot width 114 amounts to about 7.2 mm in the exemplary embodiment.

The upper wedge opening 80 is delimited, toward the front 79, by a front wall part 216 of the contact wall part 63.1 of the upper head part 74. This front wall part 216 is also an integral part of the upper horizontal wall part 213, which delimits the upper head part 74, toward the top 110, by a horizontal outer surface 217, which is configured parallel to the center plane 68 of the slot 67. Toward the inside 123, toward the wedge accommodation space 84, the upper horizontal wall part 213 is delimited by a horizontal inner surface 212 that runs at a slant to the horizontal outer surface 217, toward the top 110 and rear or outside 52. The horizontal wall part 213 makes a transition into a rear wall part 220 that runs at a slant toward the bottom 115 and rear 52, up to the connection part 64. The latter part is delimited by level outer surfaces 221. The horizontal inner surface 212 of the upper horizontal wail part 213 makes a transition, on both sides of the upper wedge opening 80, toward the rear 52, into wedge guide surfaces 222.2, 222.2 of wedge guide edges 223.1, 223.2 that run at a slant toward the rear 52 and bottom 115. The wedge guide edge 223.1, 223.2, in each instance, is configured with wedge guide surfaces 222.1, 222.2 that extend approximately perpendicular to the vertical plane of symmetry 90. These surfaces delimit the rear wall part 220, toward the wedge accommodation space 84. The wedge guide edges 223.1, 223.2 or their wedge guide surfaces 222.1, 222.2 make a transition, at a slant toward the rear 52 and bottom 115, tangentially into the accommodation pocket 132 or its inner surfaces. The wedge guide edges 223.1, 223.2 or the wedge guide surfaces 222.1, 222.2 allow advantageous guidance of the wedge 62 on or by way of its material thickening, here the rivet heads 209.1, 209.2, which are provided in the region of the lower wedge end 109 of the wedge 62. This will be discussed in greater detail below.

The upper contact wall part 63.1 of the upper head part 74 that has the front upper contact support surfaces 65.1 is delimited, toward the rear 52 and bottom 115, toward the wedge accommodation space 84, by an inner, essentially level, vertical, upper wedge support surface 225. The upper wedge support surface 225 extends approximately from the upper horizontal outer surface 217 of the upper horizontal wall part 213 of the upper head part 74, parallel to a or the vertical axis 148. The upper wedge support surface 225 extends vertically toward the bottom 115, up to approximately the upper slot surfaces 95.1, 95.2 in the introduction region 93.

The vertical axis 148 is determined by an essentially level, vertical wedge support surface 229 that delimits a, preferably each perforation 55; 55.1, 55.2 of the perforations 55; 55.1, 55.2 of the perforated disk 44 radially toward the outside 52, which perforation extends from the upper delimitation surface 48 all the way to the lower delimitation surface 49 of the perforated disk 44. This vertical axis 148, with which the longitudinal axis 47 of the post 41 also runs parallel, ideally corresponds to the plumb line, in the constructed state of the post 41 or of the arrangement 230 for a scaffolding 40 or of a scaffolding 40 that contains this post and the connection head 61 with the wedge 62. It is understood that the vertical axis 148 can be inclined relative to the plumb line, at a certain inclination angle, within the scope of construction or suspension deviations that occur in practice.

The lower contact wall part 63.2 of the lower head part 75 is delimited, toward the rear 52 and bottom 115, toward the wedge accommodation space 84, by an inner, essentially level, vertical lower wedge support surface 231. The lower wedge support surface 231 extends approximately from the front end 232 of the lower introduction region 93.2 of the lower head part 75, in the region of the lower introduction bevel 117, parallel to the vertical axis 148, vertically toward the bottom 115. In this connection, the lower wedge support surface 231 extends approximately to a lower horizontal surface 218 of the lower horizontal wall part 214 of the lower head part 75, which surface delimits the lower head part 75 toward the bottom 115.

The upper horizontal wall part 213 is delimited, toward the top 110, by an upper horizontal surface 217, and the lower horizontal wall part 214 is delimited, toward the bottom 115, by a lower horizontal surface 218, which surfaces extend parallel to one another and parallel to the center plane 68 of the slot 67. The upper horizontal wall part 213 or its upper horizontal surface 217, and also the lower horizontal wall part 214 or its horizontal surface 218, viewed in vertical section containing the vertical plane or the vertical plane of symmetry 90, have a different length 213, 234. The length 233 of the upper horizontal wall part 213 or its upper horizontal wall surface 217 is less than the length 234 of the lower horizontal wall part 214 or its lower horizontal wall surface 218. The vertical upper wedge support surface 225 and the vertical lower wedge support surface 231 run parallel to one another.

The connection part 64 of the connection head 61 is delimited, toward the rear 52, by an impact ring surface 141 that runs continuously on the entire circumference, which surface is configured perpendicular to the vertical plane of symmetry 90 and perpendicular to the center plane 68 of the slot or perpendicular to the longitudinal axis 94 of the rod element 78 or of the round tube 78. The impact ring surface 141 is delimited, in the radial direction toward the outside, with reference to an intersection line at which the vertical plane of symmetry 90 and the center plane 68 of the slot 67 intersect perpendicularly, or, with reference to the longitudinal axis 94 of the rod element 78, in the radial direction toward the outside, by an outside diameter 247 that is slightly less than the outside diameter 235 of the rod element 78 in the connection region. In this way, advantageous automatic welding conditions are obtained.

The impact ring surface 141 is delimited, with reference to the intersection line in which the vertical plane of symmetry 90 and the center plane 68 of the slot intersect perpendicularly, or, with reference to the longitudinal axis 94 of the rod element 78, in the radial direction toward the inside, by an inside diameter 248. This diameter is slightly less than the inside diameter 249 of the rod element 78 in the connection region.

Three centering tabs 250.1, 250.2, 250.3 extend in the direction toward the rear 52, beyond the impact ring surface 141, which tabs can be inserted into the rod element or into the round tube 78 or are inserted there. In the exemplary shown, the centering tabs 250.1, 250.2, 250.3 are disposed offset relative to one another, not at equal circumference angles. It is understood, however, that such or similar centering tabs can also be disposed at equal circumference angles relative to one another. In the exemplary embodiment shown, the two centering tabs 250.1 and 250.3 are disposed offset relative to one another by a circumference angle 251.1 of about 180 degrees. In contrast to this, the further centering tab 250.2, disposed between these two centering tabs 250.1 and 250.3, viewed in the circumference direction, is disposed offset relative to the adjacent centering tab 250.1, 250.3, in each instance, at an equal circumference angle 251.2 of only about 90 degrees (FIG. 10). In this connection, the said further centering tab 250.2 is assigned to the lower head part 75 of the connection head 61.

The impact ring surface 141, viewed in a longitudinal section that contains the vertical plane or the vertical plane of symmetry 90, has a distance from the front contact support surfaces 65.1, 65.2 of the upper and the lower contact wall part 63.1, 63.2 of the connection head 61, which distance is equal in size to the corresponding distance 252 of the previous connection heads of the LAYHER Allround scaffolding system or corresponding scaffolding systems. This distance 252 amounts to about 50 mm. The connection head 61 according to the invention is therefore structured in optimized manner, also in this regard, while maintaining the general design conditions predetermined by the modular system. However, not only all the measures according to the invention relating to the connection head 61, but also all the measures according to the invention relating to the wedge 62 are optimized, according to the invention, in such a manner that integration or combinability with the existing scaffolding parts is easily possible.

In the following, an arrangement 230 according to the invention will be described, in which the connection head 61 of the scaffolding component 45, with its slot 67, is mounted horizontally onto the perforated disk 44, and in which the wedge 62 is inserted through the upper wedge opening 80, through a perforation 55.1 of the perforations 55.1, 55.2 of the perforated disk, 44, and through the lower wedge opening 81, so that the wedge 62 is in a locking position 88, in which the connection head 61 is locked, with shape fit, to the perforated disk 44, to prevent removal of the connection head 61 from the perforated disk 44, in all possible directions, and in which the connection head 61 can only be removed from the perforated disk 44 after the wedge 62 has been unlocked by means of a force that acts on the wedge 62. Such an arrangement 230 or installation and fastening situation is particularly illustrated in FIGS. 3, 4, and 5.

In the locking position 88, the wedge 62 can be laid or is laid, with the vertical, essentially level contact surface 168 of its rear or first wedge face edge 162, only locally, specifically in the region of an upper recess edge 280 of the perforation 55.1 of the perforated disk 44, in dot or line form, against the corresponding, essentially level vertical wedge support surface 229 of the perforated disk 44, which surface delimits the perforation 55.1 of the perforated disk 44 toward the rear or outside 52 and extends parallel to the vertical axis 148. At the same time, the wedge 62, with the essentially level, vertical contact surface 166 of its front or second wedge face edge 163, which extends parallel to the vertical axis 148, can be laid or is laid, not only over its full area, against the corresponding inner, essentially level, inner upper wedge support surface 225 of the upper head part 74, which faces toward the rear 52, which surface also extends parallel to the vertical axis, but also over its full area against the corresponding, essentially level, inner lower wedge support surface 231 of the lower head part 75, which also extends parallel to the vertical axis 148.

Specific parts of the invention can also be described as follows, in a further or other representation: The upper head part 74, on an inner side 83, in the transverse direction 118, of the passage 84, has an essentially level upper wedge support surface 225 for the wedge 62, which faces toward the outside 52 in the transverse direction 118 and extends parallel to the vertical axis 148. The lower head part 75, on an inner side 83, in the transverse direction 118, of the passage 84, has an essentially level lower wedge support surface 231 for the wedge 62, which faces toward the outside 52 in the transverse direction 118 and extends parallel to the vertical axis 148. The upper wedge support surface 225 and the lower wedge support surface 231 are configured parallel and without any lateral offset relative to one another or aligning with one another.

The wedge 62 has a rear edge that faces toward the rear or toward the outside 52 or a first wedge face edge 162, which has an essentially level contact surface 168 that extends at a slant in the direction toward the outside 52 and bottom 115, at an inclination angle 170 relative to the vertical axis 148, along a slanted axis 169. The contact surface 168 of the first wedge face edge 162 lies against the vertical wedge support surface 229 of the outer projection part 97, which surface faces toward the inside or front 79, only locally in the region of the upper recess edge 280 of a perforation 55; 55.1 of the projection or of the perforated disk 44, when the wedge 62 is in the locking position 88 and the connection head 61 is braced against the vertical scaffolding element 41, using the wedge 62, or when the wedge 62 is in the locking position 88, The wedge 62 furthermore has a front edge or second wedge face edge 163 that faces toward the front or toward the inside 79 in the transverse direction 118, which edge has an essentially level, vertical contact surface 166 that extends parallel to the vertical axis 148 or in a straight line. The contact surface 166 corresponds not only to the upper wedge support surface 225 of the upper head part 74 but also to the lower wedge support surface 231 of the lower head part 75, in such a manner that the vertical contact surface 166 of the wedge 62 and the two vertical wedge support surfaces 225, 231 of the connection head 61 can be displaced relative to one another, lying against one another over the full area and parallel to one another, along or in the direction of the vertical axis 148.

Accordingly, the wedge 62 of the connection head 61, when the connection head 61 is mounted onto a projection or onto a perforated disk 44 of a vertical scaffolding element or scaffolding post 41 as intended, in such a manner that the wedge 62 is inserted through the passage 84 formed in the upper head part 74 and in the lower head part 75, intersecting the slot 67, through a perforation 55; 55.1 of the projection or of the perforated disk 44, and accordingly is in a locking position 88, lies against the corresponding wedge support surfaces 225, 231 of the straight inner edges or the vertical wedge support surfaces 225, 231 of the upper head part 74 and of the lower head part 75 with its front, straight, vertical front edge, which faces in the direction of the vertical scaffolding element or scaffolding post 41, or second wedge face edge 163 or with the contact surface 166, while the wedge 62, at the same time, lies against the inner edge, which extends vertical or in a plumb line parallel to the vertical axis 148, or the latter's wedge support surface 229 of the perforation 55; 55.1, against the upper recess edge 280 of the projection or of the perforated disk 44 with its rear, slanted rear edge, which faces away from the vertical scaffolding element or the scaffolding post 41, or the first wedge face edge 162 or the latter's contact surface 168, in dot or line form.

The upper contact part 63.1 of the upper head part 74 and the lower contact wall part 63.2 of the lower head part 75 have the same or a uniform thickness 288, viewed in the vertical direction 110, 115, parallel to the vertical axis 148, for example in the vertical cross-section shown in FIGS. 4 and 6. The thickness 288 preferably amounts to about 8.0 mm. Furthermore, viewed in the same vertical cross-section, the wedge support surfaces 225, 231, facing toward the outside 52, not only of the upper contact wall part 61.1 of the upper head part 74 but also of the lower contact wall part 61.2 of the lower head part 75, extend parallel to the contact support surfaces 65.1 and 65.2.

It is understood that the invention is not restricted to the exemplary embodiments shown in the figures and described above, but rather that an arrangement according to the invention or a scaffolding component according to the invention or a fastening method according to the invention can also be configured, dimensioned and/or structured differently, within the scope of the idea of the invention particularly laid down in the claims and in the specification. In particular, the technical characteristics and measures that can be derived from the claims and the specification, to the extent that they can be implemented, are in accordance with the invention individually or can be combined in any desired number.

REFERENCE SYMBOL LIST

40 scaffolding/modular scaffolding
41 vertical scaffolding element/post/rod element
42 axial direction/vertical direction/thickness direction
43 grid dimension
44 connection element/projection/rosette/perforated disk
45 scaffolding component/connection, holding, support element/longitudinal bar/scaffolding bar
46 round tube
47 longitudinal axis of 41
48 upper delimitation surface of 44

49 lower delimitation surface of 44
50 perforated disk thickness
51 center plane of 44
52 toward the rear/outside
53 rod element
54 outer surface of 41
54.1 upper outer surface of 41
54.2 lower outer surface of 41
55 passage hole/perforation/aperture
55.1 small perforation
55.2 large perforation
56.1 end of 45
56.2 end of 45
57 top side of 44
58 underside of 44
59 circumference angle
60 circumference direction
61 connection head
62 wedge
63 contact part of 61
63.1 upper contact wall part
63.2 lower contact wall part
64 connection part of 61
65.1 upper contact support surface
65.2 lower contact support surface
67 slot
68 center plane/horizontal center plane of 67
69 radius
70 outer radius of 46
71.1 upper side wall part
71.2 upper side wall part
71.3 lower side wall part
71.4 lower side wall part
72.1 upper vertical outer surface
72.2 upper vertical outer surface
72.3 lower vertical outer surface
72.4 lower vertical outer surface
73 wedge angle
74 upper head part of 61
75 lower head part of 61
76.1 upper outer surface of 41
76.2 lower outer surface of 41
77.1 post part of 41
77.2 post part of 41
78 component/rod element/round tube
79 toward the front/inside
80 upper wedge opening
81 lower wedge opening
82 perforation
83 inner side of 84
84 wedge accommodation space/passage
85 wedge support body
86 wedge pivot counter-bearing
87 interior space of 78
88 locking position
89.1 upper inner edge of 66.1
89.2 lower inner edge of 66.2
90 vertical symmetry plane/vertical plane
91 vertical central axis
92.1 vertical plane
92.2 vertical plane
93 introduction region
93.1 upper introduction region
93.2 lower introduction region
94 longitudinal axis of 78
95.1 upper slot surface
95.2 upper slot surface
96.1 lower slot surface
96.2 lower slot surface
97 (outer) projection part/edge crosspiece
98 first slot height/slot width/vertical distance
99 upper slot surface
99.1 upper slot surface
99.2 upper slot surface
100 shoulder/support body
101 longitudinal direction of 80
102.1 vertical slot surface
102.2 vertical slot surface
103 slot bottom
103.1 slot bottom
103.2 slot bottom
104 longitudinal direction of 80
105 essentially horizontal mounting direction/essentially horizontal
106 slot width/slot height/distance
107 upper shoulder slot surface
108 wedge support surface of 85
109 lower wedge end
110 toward the top
111 narrowing
112 (upper) wall part
113 slanted surface of 100
114 slot width of 80
115 toward the bottom
116 upper introduction bevel
117 lower introduction bevel
118 transverse direction
119 (the) interior of 61
120 direction/tangential
121 horizontal plane
122.1 inner delimitation surface
122.2 inner delimitation surface
123 inside space/interior
124 (upper) front delimitation edge of 86
125 first vertical slot surface distance
126 second vertical slot surface distance
127 wedge end part
128 lower/front/inner delimitation edge/release edge/lower end of 85
129 vertical distance
130 inner radius
131 outer radius
132 accommodation pocket
133 inside contour of 132
134 circumference angle
135 outside contour
136 inclination angle
137 distance
138 surface of 140
139 inner wall part of 74
140 upper wall part
141 impact ring surface
142 horizontal distance
143.1 centering support tab
143.2 centering support tab
144.1 centering support surface
144.2 centering support surface
145 thickness of 62/wedge thickness
146 upper region of 132
147 zinc run-out opening
148 vertical axis
149 cavity
150 inside diameter of 147
151.1 first distance

151.2 first distance
152 upper end of 65.2
153.1 second distance
153.2 second distance
154 lower end of 65.2
155 outer surface of 78
156 vertical distance
157 horizontal distance
161.1 wedge side surface
161.2 wedge side surface
162 (rear/outer) first wedge face edge
163 (front/inner) second wedge face edge
166 upper (front/inner) contact surface of 163
168 (rear/outer) contact surface of 162
169 slanted axis
170 inclination angle
181 upper wedge end/drive-in end
182 upper wedge edge
183 upper drive-in wedge surface
184 radius
185 rear, upper end of 183
186 radius
190 upper wedge part
191 (maximal) wedge part width
192 distance
193 slanted surface
195 inclination angle
196 distance
197 vertical surface
198 lower wedge width
199 length of 197
200 wedge end surface
201 wedge end part
202 bore
203 retainer/thickening/rivet
204 radius
205 vertical surface
206 elevation
207 bridging recess
209.1 rivet head
209.2 rivet head
210 maximal rivet head diameter
211 rivet width
212 inner (delimitation) surface/horizontal surface/support surface of 213
213 upper horizontal wall part
214 lower horizontal wall part
215 longitudinal slot
216 wall part
217 (upper) horizontal (outer) surface of 213
218 (lower) horizontal (outer) surface of 214
220 rear wall part
221 outer surface of 220
222.1 wedge guide surface
222.2 wedge guide surface
223.1 wedge guide edge
223.2 wedge guide edge
225 upper wedge support surface
229 (vertical) wedge support surface of 55
230 arrangement
231 lower wedge support surface
232 front/inner end of 93.2
233 length of 213
234 length of 214
235 outside diameter of 78
236 radial (inner/rear) side of 84
241.1 upper scaffolding element part/post part
241.2 lower scaffolding element part/post part
247 outside diameter of 141
248 inside diameter of 141
249 inside diameter of 78
250.1 centering tab
250.2 centering tab
250.3 centering tab
251.1 circumference angle
251.2 circumference angle
252 distance
253 upper pivot position
260 (inner) edge crosspiece/projection part
263 (initial) installation position
265 installer
266 secured position
267 leading railing
268 railing/back-hip railing
269 scaffolding deck
270.1 scaffolding field
270.2 adjacent scaffolding field
277 knee rail
280 recess edge
281 support position
282 (front) introduction bevel
283 inclination angle of 113
284 direction (toward the inside)
285.1 (lateral) introduction bevel
285.2 (lateral) introduction bevel
286.1 slanted surface of 285.1
286.2 slanted surface of 285.2
287.1 inclination angle
287.2 inclination angle
288 thickness of 63.1, 63.2
289 inside diameter of 82
290 (maximal) width of 61

The invention claimed is:

1. Arrangement comprising:

a scaffolding component having a connection head, a vertical scaffolding element having a longitudinal axis and extending in the direction of the longitudinal axis, a projection fastened onto the vertical scaffolding element, the projection extending transversely relative to the longitudinal' axis of the vertical scaffolding element away from the longitudinal axis, and a wedge for locking the connection head to the projection, wherein the connection head is mounted onto the projection with a releasable connection, wherein the projection has an upper delimitation surface and a lower delimitation surface, which extend on both sides of a horizontal center plane of the projection, wherein the projection has at least one perforation for inserting a wedge through it, which perforation is disposed between an inner projection part, in the transverse direction, of the projection, and an outer projection part, in the transverse direction, of the projection, and extends vertically between the upper and the lower delimitation surface, wherein the connection head has an upper head part having an upper wedge opening, and a lower head part having a lower wedge opening, for the wedge that can be inserted through the wedge openings, wherein the connection head has a contact part that has contact wall parts having contact support surfaces that extend vertically, for contact against corresponding, vertically extending outer surfaces of the vertical scaffolding element, wherein the upper head part has an upper contact support surface of the contact support surfaces for contact against a corresponding upper outer surface of a scaffolding element part of the vertical scaffolding element that extends above the projection, wherein the lower head part has a lower contact support surface of the contact support surfaces for contact against a corresponding lower outer surface of a scaffolding element part of the vertical scaffolding element that extends to below the projection, wherein a slot that is open toward the front toward the contact support surfaces, is disposed between the upper head part and the lower head part, with which slot the connection head is mounted onto the projection, wherein the slot, in a front introduction region, is delimited, toward the top, by horizontal upper slot surfaces of the upper head part, and toward the bottom by horizontal lower slot surfaces of the lower head part, which surfaces extend essentially parallel to one another, on both sides of a horizontal center plane of the slot, wherein the slot is delimited, in the transverse direction, toward the rear, by vertically extending slot surfaces of a slot bottom, wherein a passage for the wedge is configured between the upper wedge opening and the lower wedge opening, which passage extends through the upper head part and through the lower head part, intersecting the slot, and aligns with the perforation of the projection, wherein the wedge is inserted through the passage and through the perforation of the projection, so that the connection head of the scaffolding component is locked into the projection, with shape fit, using the wedge that is in a locking position, wherein the wedge can be moved through the passage toward the top, to unlock the connection head from the projection, at least up to beyond the upper delimitation surface of the projection, so that then, the connection head can be removed from the projection, wherein the upper head part is supported on the upper outer surface of the vertical scaffolding element with the upper contact support surface, and the lower head part is supported on the lower outer surface of the vertical scaffolding element with the lower contact support surface, either already when the wedge is in the locking position or when the wedge is in the locking position and the connection head is braced against the vertical scaffolding element using the wedge, wherein the upper head part sits on the upper delimitation surface of the projection with a support body delimited by an upper slot surface of the slot, in a support position, wherein in the support position, the upper contact support surface extends vertically toward the top, all the way to an upper end that is disposed at a first distance from the horizontal center plane of the slot and at a first distance from the horizontal center plane of the projection, wherein in the support position, the lower contact support surface extends vertically toward the bottom, all the way to a lower end that is disposed at a second distance from the horizontal center plane of the slot and at a second distance from the horizontal center plane of the projection, wherein the outer projection part of the projection has a vertical wedge support surface for the wedge, which surface faces toward the inside and delimits the perforation toward the outside, and extends between the upper delimitation surface and the lower delimitation surface of the projection, parallel to or along or in the direction of a vertical axis, wherein the upper head part has a vertical, upper wedge support surface for the wedge, on an inner side of the passage, in the transverse direction, which surface faces toward the outside in the transverse direction, and extends parallel to the vertical axis, wherein the lower head part has a vertical, lower wedge support surface for the wedge, on an inner side of the passage, in the transverse direction, which surface faces toward the outside in the transverse direction, and extends parallel to the vertical axis, wherein the wedge has a first wedge face edge that has a contact surface that extends at a slant in the direction toward the inside and bottom, at an inclination angle relative to the vertical axis, along an inclined axis, and faces toward the outside, which surface, when the wedge is in the locking position and the connection head is braced against the vertical scaffolding element using the wedge, and/or when the wedge is in the locking position, lies against the vertical wedge support surface of the outer projection part only locally, wherein the wedge has a second wedge face edge that faces toward the inside in the transverse direction, which edge has a vertical contact surface that extends parallel to the vertical axis, which surface corresponds to the vertical upper wedge support surface of the upper head part and to the vertical lower wedge support surface of the lower head part, in such a manner that the vertical contact surface of the wedge can be displaced, lying against not only the vertical upper wedge support surface of the connection head but also the vertical lower wedge support surface of the connection head, relative not only to the vertical upper wedge support surface but also the vertical lower wedge support surface, parallel to or along or in the direction of the vertical axis, wherein the slot, in the direction toward its slot bottom or in the region of its slot bottom or in a rear region of the slot, is structured with a shoulder of the upper head part that extends to below the upper slot surfaces of the slot configured in the introduction region, which shoulder is delimited, toward the bottom, by a horizontal upper shoulder slot surface of the slot, and wherein the shoulder, disposed in the support position above the horizontal upper delimitation surface of the outer projection part of the projection, is supported, with its full area, on the upper delimitation surface of the projection, with its shoulder slot surface that extends parallel to the horizontal upper delimitation surface of the projection, in the support position and at least when the wedge is in the locking position and the connection head is braced against the vertical scaffolding element, using the wedge, or already when the wedge is in the locking position, so that the first distance of the upper end of the upper contact support surface of the upper head part from the horizontal center plane of the projection and the second distance of the lower end of the lower contact support surface of the lower head part from the horizontal center plane of the projection are equal in size.

2. Arrangement according to claim 1, wherein the shoulder is disposed in the region of a vertical plane configured perpendicular to the horizontal center plane of the slot, extending in the longitudinal direction of the upper wedge opening, passing through the upper wedge opening.

3. Arrangement according to claim 2, wherein the shoulder is configured on both sides of the vertical plane, containing the vertical plane.

4. Arrangement according to claim 1, wherein the upper head part of the connection head is delimited by upper vertical outer surfaces of upper side wall parts, which are delimited by horizontal, upper slot surfaces of the slot that face toward the bottom, and wherein the shoulder slot surface of the shoulder is disposed to be offset toward the inside, in other words in the direction of an interior of the connection head relative to the vertical outer surfaces of the upper side wall parts, in a direction that is not only perpendicular to the transverse direction but also perpendicular to the vertical axis.

5. Arrangement according to claim 4, wherein the shoulder slot surface of the shoulder is disposed to be offset relative to the horizontal upper slot surfaces of the upper side wall parts, in the direction toward the inside.

6. Arrangement according to claim 4, wherein the shoulder is provided with lateral introduction bevels that are provided, in each instance, with a slanted surface, and extend, proceeding from the horizontal shoulder slot surface of the shoulder, at a slant toward the top and laterally toward the vertical outer surface, in each instance, of the upper side wall part, in each instance.

7. Arrangement according to claim 4, wherein the shoulder extends continuously between the top side wall parts.

8. Arrangement according to claim 1, wherein the shoulder is provided with a front introduction bevel that is provided with a slanted surface that extends, proceeding from a horizontal shoulder slot surface of the shoulder, at a slant toward the front or inside and top.

9. Arrangement according to claim 1, wherein the shoulder slot surface of the shoulder that is supported, over its full area, on the upper delimitation surface of the projection in the support position, extends at a vertical first slot surface distance below the horizontal upper slot surfaces of the slot provided in the introduction region, wherein the horizontal lower slot surfaces of the slot, which run parallel to the horizontal upper slot surfaces, extend at a vertical second slot surface distance below the lower delimitation surface of the projection that runs parallel to the upper delimitation surface, and wherein the first slot surface distance is equal in size to the second slot surface distance.

10. Arrangement according to claim 1, wherein the horizontal upper slot surfaces of the upper head part and the horizontal lower slot surfaces of the lower head part extend on both sides of the horizontal center plane of the slot, at a distance corresponding to a first slot height, parallel to one another, which has a distance from the said horizontal slot surfaces, corresponding to essentially half the first slot height, and wherein the first distance of the upper end of the upper contact support surface of the upper head part from the horizontal center plane of the slot and the second distance of the lower end of the lower contact support surface of the lower head part from the horizontal center plane of the slot are equal in size.

11. Arrangement according to claim 1, wherein the horizontal center plane of the slot and the horizontal center plane of the projection essentially coincide.

12. Arrangement according to claim 1, wherein the upper contact support surface of the upper head part and the lower contact support surface of the lower head part are equal in size.

13. Arrangement according to claim 1, wherein the upper contact support surface of the upper head part and the lower contact support surface of the lower head part are configured symmetrical to the horizontal center plane of the projection and/or symmetrical to the horizontal center plane of the slot.

* * * * *